US006641967B2

(12) United States Patent
Takiguchi et al.

(10) Patent No.: US 6,641,967 B2
(45) Date of Patent: Nov. 4, 2003

(54) CARRIER FOR ELECTROPHOTOGRAPHY, TWO COMPONENT TYPE DEVELOPER, AND IMAGE FORMING METHOD

(75) Inventors: Tsuyoshi Takiguchi, Kawasaki (JP); Kenji Okado, Yokohama (JP); Tetsuya Ida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/107,053

(22) Filed: Mar. 28, 2002

(65) Prior Publication Data

US 2003/0008226 A1 Jan. 9, 2003

Related U.S. Application Data

(62) Division of application No. 09/941,784, filed on Aug. 30, 2001, now abandoned, which is a division of application No. 08/493,009, filed on Jun. 21, 1995, now Pat. No. 6,316,156.

(30) Foreign Application Priority Data

Jun. 22, 1994 (JP) ..... 6-162896

(51) Int. Cl.[7] ..... G03G 13/08
(52) U.S. Cl. ..... 430/120; 430/103; 430/122
(58) Field of Search ..... 430/109.4, 108.6, 430/111.4, 111.31, 111.41, 111.32, 111.33, 122, 120, 103; 399/270, 55, 285

(56) References Cited

U.S. PATENT DOCUMENTS

| | | | | |
|---|---|---|---|---|
| 3,546,122 A | | 12/1970 | Nishizawa et al. | 252/62.63 |
| 3,942,979 A | | 3/1976 | Jones et al. | |
| 3,969,251 A | | 7/1976 | Jones et al. | 252/62.1 P |
| 4,040,969 A | | 8/1977 | Jones | 252/62.1 R |
| 4,075,391 A | | 2/1978 | Berg et al. | 428/407 |
| 4,122,024 A | | 10/1978 | Jones et al. | 252/62.1 P |
| 4,126,454 A | | 11/1978 | Jones | |
| 4,485,162 A | | 11/1984 | Imamura et al. | |
| 4,590,141 A | | 5/1986 | Aoki et al. | |
| 4,623,603 A | | 11/1986 | Imura et al. | |
| 4,863,823 A | * | 9/1989 | Hiro et al. | 430/66 |
| 4,904,558 A | | 2/1990 | Nagatsuka et al. | 430/122 |
| 4,985,327 A | | 1/1991 | Sakashita et al. | |
| 5,093,220 A | | 3/1992 | Masaki et al. | |
| 5,268,249 A | | 12/1993 | Saha et al. | |
| 5,346,792 A | | 9/1994 | Kobayashi et al. | |
| 5,422,216 A | | 6/1995 | Smith et al. | |
| 5,424,161 A | | 6/1995 | Hayashi et al. | |
| 5,429,902 A | | 7/1995 | Saito et al. | |
| 5,518,642 A | | 5/1996 | Inoue et al. | 252/62.56 |
| 5,578,409 A | | 11/1996 | Kotaki et al. | |
| 5,669,050 A | * | 9/1997 | Sakemi et al. | 399/270 |
| 5,795,693 A | | 8/1998 | Okado et al. | |

FOREIGN PATENT DOCUMENTS

| | | | | |
|---|---|---|---|---|
| EP | 0142731 | | 5/1985 | |
| EP | 0334099 | | 9/1989 | |
| EP | 0584555 | | 3/1994 | |
| FR | 2330041 | | 5/1977 | |
| GB | 2126925 A | * | 4/1984 | 430/122 |
| JP | 49-70630 | | 7/1974 | |
| JP | 51-3238 | | 1/1976 | |
| JP | 51-3244 | | 1/1976 | |
| JP | 59-111926 | | 6/1984 | |
| JP | 200551 | | 9/1986 | |
| WO | 92-02861 | | 2/1992 | |

OTHER PUBLICATIONS

Patent Abstracts of Japan, vol. 11, No. 029 (p. 540) Jan. 1997.

Patent Abstract of Japan, vol. 14, No., 148, p. 1024, Mar. 1990.

PTO Translation of JP 61–20051 (Sep. 5, 1986).

* cited by examiner

*Primary Examiner*—Janis L. Dote
(74) *Attorney, Agent, or Firm*—Fitzpatrick, Cella, Harper & Scinto

(57) ABSTRACT

A carrier for electrophotography and a two component type developer using the carrier. The carrier is composed of magnetic particles of a magnetic ferrite component represented by Formula: $(Fe_2O_3)_X(MnO)_Y(A)_Z$. An image forming method is also disclosed which uses the two component type developer.

16 Claims, 4 Drawing Sheets

CARRIER FOR ELECTROPHOTOGRAPHY, TWO COMPONENT TYPE DEVELOPER, AND IMAGE FORMING METHOD

This application is a division of application Ser. No. 09/941,784, filed Aug. 30, 2001, now abandoned, which, in turn, is a division of application Ser. No. 08/493,009, filed Jun. 21, 1995 now issued as U.S. Pat. No. 6,316,156.

BACKGROUND OF THE INVENTION

1. Field of the Invention

The present invention relates to a carrier which composes a two component type developer used to develop an electrostatic latent image or magnetic latent image in electrophotography or electrostatic printing, and a two component type developer making use of the carrier. More particularly, it relates to a carrier which composes a two component type developer remarkably improved in running performance and environmental properties, and a two component type developer making use of the carrier. The present invention also relates to an image forming method carried out using the two component type developer.

2. Related Background Art

As developing methods for electrophotography, there are a number of methods such as cascade development and magnetic brush development. Developers used in these developing methods include one-component type developers and two component type developers.

Carriers that compose such two component type developers can be roughly grouped into a conductive carrier and an insulative carrier. The conductive carrier is usually comprised of oxidized or unoxidized iron powder. Two component type developers comprised of this iron powder carrier, however, have the problem that the triboelectric chargeability to a toner is unstable and hence fog tends to occur on visible images formed. More specifically, as the two component type developer is used, toner particles adhere to and accumulate on the surfaces of the iron powder carrier particles (i.e., toner is spent), so that the electrical resistance of carrier particles increases to lower bias currents, and also to make the triboelectric chargeability unstable, resulting in a decrease in the image density of visible images formed and an increase of fog. Thus, when copies are continuously taken by an electrophotographic copying machine by the use of the two component type developer containing the iron powder carrier, the two component type developer may deteriorate upon copying on a small number of copy sheets and hence it becomes necessary to change the two component type developer at an early stage, resulting in a high cost after all.

Accordingly, in recent years, as a measure for eliminating disadvantages of such iron powder carrier, it is proposed to use ferrite particles as the carrier (Japanese Patent Applications Laid-open No. 52-56536, No. 58-202456, etc.).

Ferrite carriers hitherto put into practical use can exhibit excellent performance not achievable by iron powder carriers, when used in specific toners and electrophotographic equipments. However, taking account of various required performances, there is still room for further improvement, and no perfect ferrite carriers are known at present. For example, even if a carrier with a proper electrical resistance can be obtained by selecting ferrite composition and firing temperature, no desired magnetic properties can be obtained, or even if the electrical resistance and magnetic properties can be kept within proper ranges, the charge quantity can not be well controlled. Such difficulties have been involved.

The insulative carrier is commonly typified by a carrier comprising carrier core particles comprised of a ferromagnetic material such as iron, nickel or ferrite whose surfaces are uniformly coated with an insulating resin. Two component type developers that employ this carrier may little cause the melt-adhesion of toner particles to the carrier surfaces, compared with the case of the conductive carrier, and at the same time the triboelectric chargeability of carriers on toners can be controlled with ease. Hence, there is the advantage that it is suitable particularly for high-speed electrophotographic copying machines in view of its superior durability and long lifetime.

There are various performances required for the insulative carrier. Particularly important performances can be set out as proper chargeability, impact resistance, wear resistance, a good adhesion between cores and coating materials, and uniformity in charge distribution.

Moreover, in recent years, there is an increasing commercial demand for making copying machines achieve a higher minuteness and making images have a higher quality. In the present technical field, it is attempted to make toner particle diameter smaller so that color images can be formed in a high image quality. Making smaller the particle diameters of toner particles, however, results in an increase in the surface area per unit weight, tending not only to bring about an excessively large quantity of triboelectricity of the toner but also a decrease in charging speed. This is accompanied with a possibility of the insufficiency of image density or the deterioration of durability or running performance such as fog and toner scatter.

That is, in the development of electrostatic latent images held on an electrostatic latent image bearing member, toner is blended with a carrier formed of relatively large particles and is used as a two component type developer for electrophotography. The composition of both the toner and the carrier is selected so that as a result of their mutual contact friction the toner can have, e.g., a polarity reverse to the charges present on the photoconductive layer. As a result of contact friction between the both, the carrier further electrostatically attracts the toner to its particle surfaces to transport the toner as a developer through a developing assembly and also feed the toner onto the photoconductive layer of the electrostatic latent image bearing member.

When, however, copies are continuously taken on many copy sheets by an electrophotographic copying apparatus using such a two component type developer, although sharp images with a good image quality can be obtained at the initial stage, edge effect with much fog may seriously occur after copies have been taken on several tens of thousands of sheets, resulting in images having poor gradation and sharpness.

In color copying carried out using toners with chromatic colors, continuous gradation is an important factor that influences image quality, and the edge effect that stresses only margins of images, occurring after copies have been taken on a large number of copy sheets, greatly damages the gradation of images. For example, quasi-contours due to the edge effect are formed in the vicinity of actual contours, resulting in a loss of copying reproducibility including color reproducibility in color copying.

Image area used in conventional black and white copying is 10% or less and images are almost held by line images as in letters, documents, reports and so forth. On the other hand, in the case of color copying, image area is 20% at least, and images are held by gradational solid images at a reasonable frequency or occupancy as in photographs, catalogues, maps, pictures and so forth.

When copies are continuously taken using such originals having a large image area, reproductions with a high image density can be obtained at the initial stage in usual instances, but the feeding of toner to the two component type developer may become insufficient with time to cause a decrease in density, or the toner being fed and the carrier may mix in the state of charge insufficiency to cause fog or cause a local increase or decrease in toner concentration (which indicates toner-carrier mixing ratio) on the developing sleeve, tending to result in blurred images or non-uniform image density. This tendency becomes more remarkable when the toner has a smaller particle diameter.

Such under-development and fog are presumed to be caused by an excessively low toner content (i.e., toner concentration) in the two component type developer or a poor rise for rapid triboelectric charging between the toner being fed and the carrier contained in the two component type developer, where any uncontrollable, insufficiently charged toner thereby produced participates in development.

It is essential for color developers to have the ability to always output images with a good image quality in the continuous copying of originals having a large image area. To deal with originals having a large image area and requiring a very large toner consumption, measures hitherto taken have more relied on improvements of developing apparatus than improvements of developers themselves. That is, it has been attempted to increase the peripheral speed of a developing sleeve or make a developing sleeve have a larger diameter so that the developing sleeve can be brought into contact with electrostatic latent images more times.

Such measures can be effective for improving developability, but may greatly limit the lifetime of apparatus because of an in-machine contamination due to toner scatter occurring in developing assemblies or because of an overload on the drive of developing assemblies. In some instances, measures are also taken in which developers are put in developing assemblies in large quantities in order to compensate the insufficiency of developability of the developers. Such measures, however, cause an increase in weight of the whole copying machine, a cost increase due to the apparatus that must be made larger in size and an overload on the drive of developing assemblies as in the above case, and are not so much preferable.

Now, studies are reported on improvements made from both directions of toners and carriers for the purpose of maintaining a high image quality over a long period of running.

For the purpose of improving image quality, several developers are proposed. For example, Japanese Patent Application Laid-open No. 51-3244 discloses a non-magnetic toner in which its particle size distribution is controlled so that the image quality can be improved. This toner is mainly composed of toner particles having a particle diameter of 8 to 12 $\mu$m, which are relatively coarse. According to studies made by the present inventors, it is difficult to "lay" the toner with such particle diameter onto latent images in a uniform and dense state, and also the toner, as having the feature that particles with a size of 5 $\mu$m or smaller are in an amount of not more than 30% by number and particles with a size of 20 $\mu$m or larger are in an amount of not more than 5% by number, tends to cause a lowering of uniformity because of a broadness of its particle size distribution. In order to form sharp images by the use of the toner comprised of such relatively coarse toner particles and having a broad particle size distribution, the toner particles must be thickly overlaid so that any spaces between toner particles can be filled up to increase apparent image density. This brings about the problem of an increase in the consumption of toner necessary to attain a given image density.

Japanese Patent Application Laid-open No. 54-72054 discloses a non-magnetic toner having a sharper particle size distribution than the above toner. This toner, however, contains medium-size particles with a size of as large as 8.5 to 11.5 $\mu$m, and has room for further improvement for a toner with a high resolution.

Japanese Patent Application Laid-open No. 58-129437 discloses a non-magnetic toner having an average particle diameter of 6 to 10 $\mu$m and held by particles with a size of 5 to 8 $\mu$m in the greatest number. This toner, however, contains particles with a size of 5 $\mu$m or smaller in an amount of as small as 15% by number, and tends to form images lacking in sharpness.

As a result of studies made by the present inventors, they have discovered that toner particles with a size of 5 $\mu$m or smaller contribute the clear reproduction of contours of latent images and have a chief function of densely "laying" the toner onto the whole latent image. In particular, electrostatic latent images on a photosensitive member have a higher electric field intensity at their edges, the contours, than at their inner sides because of concentrated lines of electric force, and the quality of toner particles gathering at the contours influences the sharpness of image quality. The studies made by the present inventors have revealed that the control of the quantity of toner particles with a size of 5 $\mu$m or smaller is effective for solving the problems concerning the sharpness of image quality.

Accordingly, the present inventors have proposed in Japanese Patent Application Laid-open No. 2-222966 a toner containing toner particles with a size of 5 $\mu$m or smaller in an amount of 15 to 40% by number. This has brought about a reasonable improvement in image quality, but it is sought to achieve a more improved image quality.

Japanese Patent Application Laid-open No. 2-877 discloses a toner containing toner particles with a size of 5 $\mu$m or smaller in an amount of 17 to 60% by number. This has certainly brought about stable image quality and image density, but it has been found that, when originals requiring a large toner consumption as in photograph originals are continuously copied, the particle size distribution of toner may change if measures are taken from the direction of toners only, making it difficult to obtain always stable images.

Meanwhile, Japanese Patent Applications Laid-open No. 51-3238, No. 58-144839 and No. 61-204646 suggest average particle diameter and particle size distribution of carriers. Of these, Japanese Patent Application Laid-open No. 51-3238 makes reference to a rough particle size distribution. It, however, has no specific disclosure as to magnetic properties closely concerned with developing performance of developers or transport performance thereof in developing apparatus. Moreover, as for the particle diameter of carrier, carriers used in Examples all contain particles with a size of 250 meshes or larger in an amount of as large as about 80% by weight or more and also have an average particle diameter of 60 $\mu$m or larger.

Japanese Patent Application Laid-open No. 58-144839 only discloses average particle diameter of a carrier. It makes reference to the quantity of fine powder that influences the adhesion of carriers to photosensitive members and the quantity of coarse powder that influences the sharpness of images. It takes account of performance of color copying, and has no detailed disclosure as to particle size distribution of carriers.

Japanese Patent Application Laid-open No. 61-204646 discloses as the gist of the invention a combination of a copying machine with a suitable developer, and has no specific disclosure as to the particle size distribution or magnetic properties of carriers. It also has no disclosure as to why the developer is effective for the copying machine.

Japanese Patent Application Laid-open No. 49-70630 has a disclosure relating to magnetic force of carriers, which, however, is concerned with iron powders used as carrier materials, having a larger specific gravity than ferrites, also having a high saturation magnetization. Iron powder carriers have been hitherto put into wide use, but, because of their large specific gravity, tend to make the weight of copying machines larger or cause an overload on drive torque, and also have a large environmental dependence.

A ferrite carrier disclosed in Japanese Patent Application Laid-open No. 58-23032 concerns a porous material with many voids. Such a carrier tends to cause the edge effect, having a poor durability, and has been found to be unsuitable for color copy carriers.

It has long been sought to provide a developer that enables continuous reproduction of images with a large image area, using a developer in a small quantity, and can satisfy the performance specific to color copying that no edge effect may occur even after running. Studies are made on developers and carriers, almost all of which, however, are proposed taking account of black and white copying, and only a little of which are proposed as those applicable also to full-color copying. It is also sought to provide a carrier having the ability to continue reproduction of images having an image area of 20% or more, which are nearly solid images, and having the ability to decrease the edge effect and maintain the uniformity of image density on a sheet of reproduction.

Under such circumstances, as disclosed in Japanese Patent Application Laid-open No. 2-281280, a carrier with a narrow particle size distribution in which the presence of fine powder and the presence of coarse powder have been quantitatively controlled, is proposed to achieve a carrier improved in developing performance.

However, as previously stated, there is an increasing commercial demand for making copying machines have a higher minuteness and making images have a higher quality. In the present technical field, it is attempted to make toner particle diameter smaller so that a color image can be formed in a high image quality. Making smaller the particle diameters of toner particles results in an increase in the surface area per unit weight, tending to bring about an excessively large quantity of triboelectricity of the toner. This is accompanied with a possibility of the insufficiency of image density or the deterioration of running performance.

Thus, for the purpose of preventing the insufficiency of image density or the deterioration of running performance, caused by the toner made to have a smaller particle diameter, or for the purpose of improving development efficiency, it is attempted to make carrier particles have a smaller diameter. Such carriers, however, have achieved no quality high enough to stand against changes in the environment of toners or changes in the quantity of triboelectricity after running, and, under existing circumstances, it is difficult to achieve all the high image density, high image quality and good anti-fogging and prevention of carrier adhesion.

SUMMARY OF THE INVENTION

An object of the present invention is to provide a two component type developer that has solved the problems discussed above, and an image forming method making use of such a two component type developer.

Another object of the present invention is to provide a carrier having the ability to provide proper charge without damaging the desired carrier electrical resistance and magnetic properties.

Still another object of the present invention is to provide a carrier that makes it possible to permanently obtain high-quality images with less fog and toner scatter on account of a higher charging speed and a uniform chargeability when used in combination with a toner having small particle diameter; a two component type developer having the toner and the carrier; and an image forming method making use of such a two component type developer.

The present invention provides a carrier for electrophotography, comprising magnetic carrier particles formed of a magnetic ferrite component represented by the following Formula (I):

$$(Fe_2O_3)_X(MnO)_Y(A)_Z \qquad \text{Formula (I)}$$

wherein A represents a member selected from the group consisting of $Na_2O$, $K_2O$, CaO, SrO and a mixture of any of these; and X, Y and Z each represent a molar fraction and satisfy the condition of:

$$0.3<X<0.8,\ 0.01<Y<0.5,\ 0<Z<0.69,\ X+Y+Z\leqq 1.$$

The present invention also provides a two component type developer comprising a toner containing toner particles and a carrier comprising magnetic carrier particles, wherein;

the magnetic carrier particles are formed of a magnetic ferrite component represented by the following Formula (I):

$$(Fe_2O_3)_X(MnO)_Y(A)_Z \qquad \text{Formula (I)}$$

wherein A represents a member selected from the group consisting of $Na_2O$, $K_2O$, CaO, SrO and a mixture of any of these; and X, Y and Z each represent a molar fraction and satisfy the condition of:

$$0.3<X<0.8,\ 0.01<Y<0.5,\ 0<Z<0.69,\ X+Y+Z\leqq 1.$$

The present invention still also provides an image forming method comprising;

rotationally transporting a two component type developer having a toner and a carrier, onto a developer carrying member; and developing in a developing zone an electrostatic latent image held on the image bearing member, using the toner of the two component type developer carried on the developer carrying member; wherein:

the toner contains toner particles; and the carrier comprises magnetic carrier particles formed of a magnetic ferrite component represented by the following Formula (I):

$$(Fe_2O_3)_X(MnO)_Y(A)_Z \qquad \text{Formula (I)}$$

wherein A represents a member selected from the group consisting of $Na_2O$, $K_2O$, CaO, SrO and a mixture of any of these; and X, Y and Z each represent a molar fraction and satisfy the condition of:

$$0.3<X<0.8,\ 0.01<Y<0.5,\ 0<Z<0.69,\ X+Y+Z\leqq 1.$$

DESCRIPTION OF THE PREFERRED EMBODIMENTS

Figure 1:
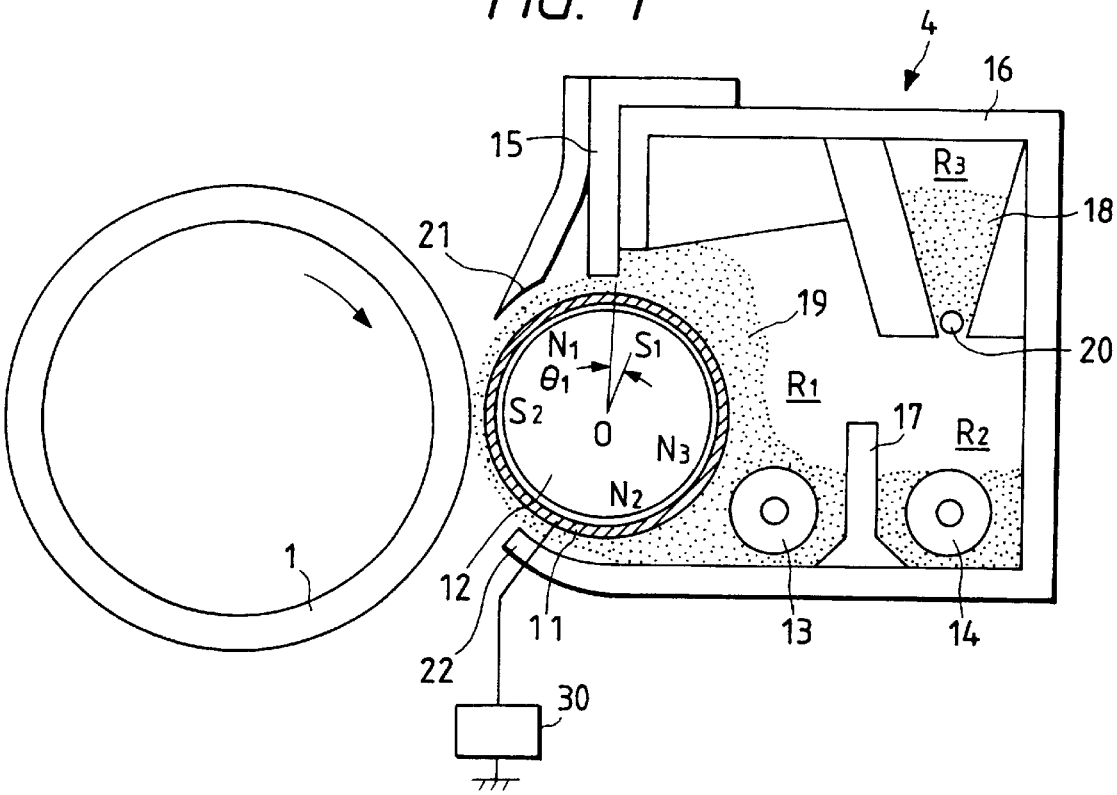
FIG. 1 illustrates an image forming system used in the image forming method of the present invention.

The carrier for electrophotography in the present invention is characterized in that the magnetic ferrite component constituting the carrier is comprised of $Fe_2O_3$ and MnO, and also, in addition thereto, at least a member selected from $Na_2O$, $K_2O$, CaO, SrO and a mixture of any of these.

$Fe_2O_3$ is a component necessary for obtaining proper magnetic properties. Especially in the magnetic brush development, it contributes achievement of a good image quality.

Incorporation of oxides of alkali metals or alkaline earth metals is effective for controlling charge quantity while maintaining the carrier electrical resistance within a proper range. In particular, the use of MnO in combination is dramatically more effective for it.

Detailed studies made by the present inventors, however, have revealed that all the alkali metals or alkaline earth metals are not always effective, and only metal atoms having physical properties within a certain range can be effective.

More specifically, in order for the respective constituents to mutually combine into solid solution and constitute a crystal lattice to enable control of electrical resistance and charge quantity, a proper ionic radius range is required in the metals contained. As a result of extensive studies made by the present inventors, the range is smaller than the proper range in the case of ionic radii of $Li^+$, $Be^{2+}$ and $Mg^{2+}$, and is greater than the proper range in the case of ionic radii of $Rb^+$ and $Cs^+$. In either case, the ranges become lower than the desired range of carrier electrical resistance, and have been unsuitable for use as carrier for electrophotography. It has also been revealed that the controlling of charge quantity requires metals to have a low ionization potential and the presence of a state of high valency, and no high charge quantity can be obtained if metals having no valence higher than that as in $Ba^{2+}$ are incorporated.

The reason why the incorporation of MnO as stated above can be especially highly effective is unclear. As one reason, it is presumed that, since an Mn oxide mutually combines with $Fe_2O_3$ into solid solution to assume a spinel structure, the electrical resistance can be controlled to a certain extent, and also since it has rather low ionization potential and yet can assume the state of high valency, a relatively high chargeability can be attained. Namely, it is presumed that when the MnO and the alkali metal or alkaline earth metal are made present together, their lattice structures or state of metal valency mutually undergo perturbation and hence the respective effects are synergetically improved for each other.

As ferrite carriers having MnO as an essential component, ferrite carriers having MnO and MgO as essential components are proposed in Japanese Patent Application Laid-open Nos. No. 58-123552 and No. 59-111159 and Japanese Patent Publication No. 6-23866, and ferrite carriers having MnO and Li2O as essential components are proposed in Japanese Patent Application Laid-open No. 58-215664, No. 59-111926 and No. 62-297857. However, according to the studies made by the present inventors, the control of electrical resistance was not well effective even when MgO or $Li_2O$ was made present together with MnO. This is presumably because in $Li^+$ or $Mg^{2+}$, the range of ionic radius is deviated from the proper ionic radius range necessary for constituting a stable and uniform crystal lattice.

In Japanese Patent Publication No. 6-23866, it is proposed that in addition to MnO and MgO the ferrite composition may be further incorporated with a metal such as Cu, Zn and Co. However, studies made by the present inventors have revealed that even the incorporation of such metal does not make it easy to improve the charge-providing ability of carriers.

This is because generally a correlation is seen between the ionization potential of metals contained in the carrier and the chargeability of carriers, where, the greater the ionization potential is, the more difficult it is for toners to be positively charged.

When comparison is made between the ionization potential of the metals contained in the ferrite composition disclosed in Japanese Patent Publication No. 6-23866 and that of the metals contained in the state of an oxide in the magnetic ferrite component in the present invention, they can be in the order as shown by the relationship:

Cu, Zn, Co>Na, K, Ca, Sr (Great←Ionization potential→Small).

Na, K, Ca and Sr have ionization potential smaller than Cu, Zn and Co, and act to be positively chargeable when contained in the carrier.

The magnetic ferrite component used in the present invention is represented by Formula (I):

$$(Fe_2O_3)_X(MnO)_Y(A)_Z \qquad \text{Formula (I)}$$

wherein A represents a member selected from the group consisting of $Na_2O$, $K_2O$, CaO, SrO and a mixture of any of these; and X, Y and Z each represent a molar fraction and satisfy the condition of:

$$0.3<X<0.8,\ 0.01<Y<0.5,\ 0<Z<0.69,\ X+Y+Z\leqq 1.$$

In the above Formula (I), in view of the improvement in chargeability of the carrier, X, Y and Z may more preferably satisfy the condition of:

$$0.3<X<0.8,\ 0.01<Y<0.5,\ X+Y<1,\ Z=1-X-Y.$$

In the present invention, for the purpose of modifying the particle diameter of crystals on the surfaces of magnetic carrier core particles, for the purpose of preventing cohesion at the time of firing, or as particle size distribution modifiers, other metal elements may also be incorporated into the magnetic ferrite component in the form of a hydroxide, an oxide, a sulfide, a fatty acid compound or the like, so long as it is not more than 3% by weight that does not damage the properties possessed by the magnetic ferrite component described above.

In the above Formula (I), if X is 3 mol % or less, the electrical resistance may become very high to make it difficult to control the resistance value. If X is 0.8 mol % or more, the magnetic properties may lower to make it difficult to obtain good image quality when used in the magnetic brush development. If Y is 0.01 mol % or less, it is difficult to control both the carrier electrical resistance and the magnetic properties within the proper ranges. If Y is 0.5 mol % or more, the magnetic properties may lower. If Z is 0 mol %, i.e., the member (A) is not contained, the chargeability may lower especially when used in combination with toners having a fine particle diameter, making it difficult to maintain running performance. If Z is 0.69 mol % or more, the charge retentivity may lower especially in an environment of high humidity, tending to cause toner scatter.

In the above Formula (I), X, Y and Z may still more preferably satisfy the condition of:

$$0.4<X<0.8,\ 0.02<Y<0.3,\ 0<Z<0.3,\ X+Y+Z=1.$$

In the present invention, if a predetermined amount of $Bi_2O_3$ is contained in the ferrite component, the electrical resistance of the carrier can be controlled to a desired value in a more broad range. When $Bi_2O_3$ is used in an controlled amount of 0.01 to 3 mol % based on the ferrite component, the electrical resistance of the carrier can be adjusted while the magnetic properties and charging ability of the carrier are kept. If the content of $Bi_2O_3$ is less than 0.01 mol %, it is difficult to control the electrical resistance of the carrier. On the other hand, if the content is more than 3 mol %, the magnetic properties of the carrier tend to change.

As an additional feature of the present invention, it can be noted that the carrier characteristics can be more remarkably effectively controlled and the performance required as the two component type developer can be more improved when the carrier has a weight average particle diameter of 50 $\mu$m or smaller.

The reason therefor is unclear, and it is presumed that an increase in carrier surface area brings about an increase in contact portions between carrier particles one another to make gentle the dependence of the electrical resistance on the ferrite composition as a carrier particle aggregate, so that it becomes possible to control the electrical resistance at a high precision.

According to the studies made by the present inventors, the carrier may more preferably have a weight average particle diameter of from 10 to 45 $\mu$m, and still more preferably from 15 to 40 $\mu$m. If the carrier has a weight average particle diameter larger than 50 $\mu$m, it becomes a little difficult to control the electrical resistance from the direction of ferrite composition, a slight decrease in charge quantity tends to be seen when a running test is made. If the carrier has too small weight average particle diameter, the carrier may conspicuously scatter from a magnet roll, tending to cause marks of blank areas on images.

As a still additional feature of the present invention, it can be noted that the carrier electrical resistance can be more delicately controlled while keeping the magnetic properties and the toner-spent can be prevented to bring about a great improvement in running performance, when the surfaces of carrier particles are coated with resin coat layers.

A coating material used to form such resin coat layers may be in a coating weight of from 0.05% by weight to 10% by weight, and more preferably from 0.1% by weight to 5% by weight, based on the weight of the carrier core particles. If it is in a coating weight less than 0.05% by weight, the coating of carrier core particles with resin coat layers can not be well effective. A coating weight of more than 10% is meaningless, and is not preferable from the viewpoint of manufacture because excess resin may become present alone.

As the resin used to form the resin coat layers of the carrier of the present invention, the following may be used.

It can be exemplified by polymers or copolymers of vinyl compounds, polyester resins, epoxy resins, melamine resins, silicone resins and fluorine- or halogen-containing resins. Any of these may be used alone or in combination of two or more kinds.

The carrier may be coated with the resin by any methods such as wet process or dry process so long as they are methods by which coat layers can be formed.

In the present invention, the carrier may preferably have an electrical resistance of from $10^6$ to $10^{15}$ Ω·cm. If the electrical resistance of the carrier is more than $10^{15}$ Ω·cm, the rise of charging of the toner being supplied may lower to tend to cause fog, especially when originals with a high image area percentage are continuously copied. On the other hand, if it is less than $10^6$ Ω·cm, the charge quantity may greatly descrease in an environment of high humidity to cause in-machine toner scatter.

Magnetic properties of carriers are affected by the magnet roller built in a developing sleeve (developer carrying member), and greatly affect the developing performance and transport performance of the two component type developer.

In the present invention, on the developing sleeve serving as a developer carrying member, having the magnet roller built therein, the two component type developer comprised of the carrier comprising magnetic particles and an insulative color toner is rotationally transported while the magnet roller is set stationary and the developing sleeve alone is rotated, and an electrostatic latent image held on the surface of a latent image bearing member is developed using the two component type developer. In this instance, color copying can enjoy good image uniformity and gradation reproduction when (1) the magnet roller is comprised of poles having a repulsion pole, (2) the magnetic flux density in the developing zone is set at 500 to 1,200 gauss and (3) the carrier has a saturation magnetization of 20 to 70 $Am^2/kg$.

If the carrier has a saturation magnetization of more than 70 $Am^2/kg$ (with respect to an applied magnetic field of 3,000 oersteds), brushlike ears formed of the carrier and the toner on a developing sleeve provided opposingly to the electrostatic latent image formed on a photosensitive member at the time of development may rise in a tight state to cause a lowering of gradation or half-tone reproduction. If it has a saturation magnetization of less than 20 $Am^2/kg$, it may become difficult for the toner and carrier to be well carried on the developing sleeve, tending to cause the problem of carrier adhesion or toner scatter.

When the carrier of the present invention is blended with a toner and used as the two component type developer that forms a magnetic brush, any toners usually used in electrophotography, comprised of a binder resin and a colorant dispersed therein, may be used without any particular limitations. Studies made by the present inventors, however, have revealed that the present invention is greatly effective when a toner with a weight average particle diameter of from 1 to 9 $\mu$m, and more preferably a weight average particle diameter of from 2 to 8 $\mu$m, is used.

In general, as the toner particle diameter is made finer, electrophotographic images become more highly minute, but on the other hand the charging speed becomes lower and also it becomes difficult to uniformly charge the whole toner particles, causing a decrease in image density and an increase in fog.

However, in the carrier of the present invention, the controlling of carrier electrical resistance to proper values on account of the compositional control of the ferrite component makes it possible to improve the charging speed and uniformly charge individual toner particles by virtue of a high chargeability, and, when used in combination with the toner made to have a finer particle diameter, makes it possible to obtain images with a very high image quality while maintaining the image density and the fog level.

When the two component type developer is prepared by blending the carrier according to the present invention with a toner, they may be blended in such a proportion that the toner in the developer is in a concentration of from 1.0% by weight to 15% by weight, and preferably from 3% by weight and 12% by weight, whereby good results can be obtained. If the toner concentration is less than 1.0% by weight, image density may become too low. If it is more than 15% by weight, fog or in-machine toner scatter may greatly occur to shorten the lifetime of the developer.

A preferred embodiment of the toner used in the two component type developer will be described below.

The toner used in the present invention may preferably have a weight average particle diameter of from 1 to 9 $\mu$m, and more preferably a weight average particle diameter of from 2 to 8 $\mu$m, as previously stated. Such a toner is preferable in view of the formation of highly minute images. If this toner has a weight average particle diameter smaller than 1 $\mu$m, its performance of blending with the carrier may lower to cause difficulties such as toner scatter and fog. If it has a weight average particle diameter larger than 9 $\mu$m, the reproducibility of minute dot latent images may lower or the toner may scatter at the time of transfer, providing a bar to the achievement of high image quality.

It is also preferable that the binder resin has a polyester resin as a main component and also the toner has an acid value of from 1 to 20 KOH mg/g.

More specifically, the use of the toner having an acid value of from 1 to 20 KOH mg/g brings about an improvement in charging stability of the carrier having the specific magnetic ferrite component described above, enables rapid charging, and can provide the two component type developer that is free from fog and toner scatter over a long period of time.

Here, if the acid value is smaller than 1 KOH mg/g, the rise of charging may lower, tending to result in an increase in fog. If the acid value is greater than 20 KOH mg/g, the chargeability in an environment of high humidity may lower, resulting in occurrence of fog and toner scatter.

In the toner used in the present invention, in order to control the acid value of the toner to be 1 to 20 KOH mg/g and improve low-temperature fixing performance and running performance of the toner, the binder resin may preferably contain as an acid component a tribasic or higher, polybasic carboxylic acid in an amount of from 0.1 to 20 mol %, and more preferably from 0.1 to 10 mol %. More preferably, the toner containing the binder resin having a polyester may have a glass transition temperature (Tg) ranging from 45 to 70° C. and a temperature (Tm) at which an apparent viscosity of $10^5$ poises is exhibited ranging from 80 to 120° C. Particularly preferably, the polyester resin may be a polyester resin obtain by co-condensation polymerization of i) a diol component comprised of an etherified bisphenol such as a bisphenol derivative or substituted bisphenol represented by the following Formula (II):

Formula (II)

(II)

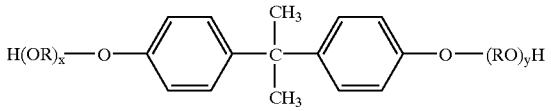

wherein R represents an ethylene group or a propylene group, and x and y each represent an integer of 1 or more, where x+y is 2 to 10 on the average; and ii) a carboxylic acid component comprising a dibasic or higher basic carboxylic acid or an acid anhydride or lower alkyl ester thereof, as exemplified by fumaric acid, maleic acid, maleic anhydride, phthalic acid, terephthalic acid, trimellitic acid and pyromellitic acid. Such a polyester resin is more preferred because of its sharp melt properties.

As the binder material used in the toner in the present invention, material resins of various types may be used in combination with the polyester resin described above.

For example, it may include polystyrene, styrene copolymers such as a styrene/butadiene copolymer and a styrene/acrylate copolymer, polyethylene, ethylene copolymers such as an ethylene/vinyl acetate copolymer and an ethylene/vinyl alcohol copolymer, phenol resins, epoxy resins, acrylphthalate resins, polyamide resins, and maleic acid resins. Regarding all the resins, there are no particular limitations on their preparation process.

The toner used in the present invention may preferably be comprised of toner particles having at least the binder resin and a colorant, and an external additive including an inorganic fine powder.

The inorganic fine powder used as the external additive of the toner may include, for example, alumina, titanium oxide and silica, among which fine particles of alumina or titanium oxide are particularly preferred because they can more stabilize the charging of toner.

The inorganic fine powder may also preferably have been subjected to hydrophobic treatment, in order for the toner to have less environmental dependence of its charge quantity on temperature and humidity and in order to prevent the powder from coming off the toner particle surfaces. An agent for this hydrophobic treatment may include, for example, coupling agents such as silane coupling agent, titanium coupling agent and aluminum coupling agent, and oils such as silicone oil, fluorine type oils and various modified oils.

Of the above hydrophobic treating agents, coupling agents are particularly preferred in view of stabilizing toner charging and providing fluidity.

Thus, as the external additive used in the present invention, particularly preferably, fine alumina or titanium oxide particles having been surface-treated while hydrolyzing the coupling agent are very effective in view of stabilizing toner charging and providing fluidity.

The inorganic fine powder having been made hydrophobic as described above may preferably have a hydrophobicity of from 20 to 80%, and preferably from from 40 to 80%.

If the hydrophobicity of the inorganic fine powder is less than 20%, charges may greatly decrease when the toner is left to stand for a long period of time in an environment of high humidity, so that a mechanism for charge acceleration becomes necessary on the side of hardware, resulting in a complicated apparatus. If the hydrophobicity is more than 80%, it becomes difficult to control the charging of the inorganic fine powder itself, tending to result in charge-up of the toner in an environment of low humidity.

The inorganic fine powder having been made hydrophobic may preferably have a number average particle diameter of from 0.005 μm to 0.2 μm in the state it is dispersed on toner particles. This is preferable in view of the fluidity of toner and the prevention of the inorganic fine powder from coming off the toner particle surfaces during running.

If the number average particle diameter is smaller than 0.005 μm, the inorganic fine powder tends to be buried in toner particle surfaces to cause a deterioration of the toner, resulting in a lowering of durability or running performance. If it is larger than 0.2 μm, it is difficult to well obtain the fluidity of the toner and the toner may be non-uniformly charged, so that toner scatter and fog tend to occur.

The above inorganic fine powder having been made hydrophobic may preferably have a light transmittance of 40% or more at a light wavelength of 400 nm.

Namely, the inorganic fine powder used in the present invention has a small primary particle diameter. When, however, actually incorporated into the toner, it is not necessarily dispersed in the state of primary particles, and may sometimes be present in the state of secondary particles. Hence, whatever the primary particle diameter is small, the present invention may become less effective if the particles behaving as secondary particles has a large effective diameter. Nevertheless, inorganic fine powder having a higher light transmittance at 400 nm which is the minimum wavelength in the visible region has a correspondingly smaller secondary particle diameter. Thus, good effects can be expected for the fluidity-providing performance and the sharpness of projected images in OHP in the case of color toners. The reason why 400 nm is selected is that it is a wavelength at a boundary region between ultraviolet and visible, and also it is said that light passes through particles with a diameter not larger than ½ of light wavelength. In view of these, any transmittance at wavelengths beyond 400 nm becomes higher as a matter of course and is not so meaningful.

The colorant contained in the toner used in the present invention may include known dyes and pigments as exemplified by Phthalocyanine Blue, Indanthrene Blue, Peacock Blue Lake, Permanent Red, Lake Red, Rhodamine Lake, Hanza Yellow, Permanent Yellow and Benzidine Yellow, any of which can be used. It may preferably be contained in an amount not more than 12 parts by weight, and more preferably from 0.5 to 9 parts by weight, based on 100 parts by weight of the binder resin, so as to ensure a sensitive reflection to light transmission properties of OHP films.

To the toner used in the present invention, additives may be optionally added so long as the properties of the toner are not damaged. Such additives may include, for example, lubricants such as Teflon, zinc stearate or polyvinylidene fluoride, and fixing auxiliaries (e.g., low-molecular weight polyethylene or low-molecular weight polypropylene), and organic resin particles.

In preparing the toner used in the present invention, it is possible to apply a method in which toner component materials are well kneaded by means of a heat kneading machine such as a heat roll, a kneader or an extruder, thereafter the kneaded product is pulverized by a mechanical means, and then the pulverized powder is classified to give a toner; a method in which toner component materials such as colorants are dispersed in a binder resin solution, followed by spray drying to give a toner; or a method of preparing a toner by polymerization, comprising mixing given materials with binder resin constituent polymerizable monomers, and subjecting an emulsion suspension of the resulting mixture to polymerization.

The image forming method making use of the two component type developer described above will be described below.

The image forming method of the present invention comprises rotationally transporting the two component type developer carried onto a developer carrying member, and developing in a developing zone defined by a latent image bearing member and the developer carrying member provided opposingly thereto, a latent image held on the latent image bearing member, using the toner of the two component type developer carried on the developer carrying member.

As previously stated, magnetic properties of carriers are affected by a magnet roller built in a developing sleeve, and greatly affect the developing performance and transport performance of developers.

In the present invention, of the developing sleeve (developer carrying member) and the magnet roller built therein, for example, the magnet roller is set stationary and the developing sleeve alone is rotated, where the two component type developer comprised of the carrier comprising magnetic particles and the insulative color toner is rotationally transported onto the developing sleeve and an electrostatic latent image held on the surface of a latent image bearing member is developed using the two component type developer.

In the image forming method of the present invention, as previously described, color copying can enjoy good image uniformity and gradation reproduction when (1) the magnet roller is comprised of five poles having a repulsion pole, (2) the magnetic flux density in the developing zone is 500 to 1,200 gauss and (3) the carrier has a saturation magnetization of 20 to 70 $Am^2$ /kg.

In the image forming method of the present invention, the electrostatic latent image may preferably be developed by the toner of the two component type developer under application of a developing bias in the developing zone.

A particularly preferred developing bias will be described below in detail.

The image forming method of the present invention may preferably comprise forming in the developing zone a developing electric field between the latent image bearing member and the developer carrying member by applying to the developer carrying member a first voltage for directing the toner from the latent image bearing member toward the developer carrying member, a second voltage for directing the toner from the developer carrying member toward the latent image bearing member and a third voltage intermediate between the first voltage and the second voltage, to develop a latent image held on the latent image bearing member, using the toner of the two component type developer carried on the developer carrying member.

In the foregoing, the time ($T_2$) for which the third voltage intermediate between the first voltage and the second voltage is applied to the developer carrying member may be made longer than the total time ($T_1$) for which the first voltage for directing the toner from the latent image bearing member toward the developer carrying member and the second voltage for directing the toner from the developer carrying member toward the latent image bearing member are applied to the developer carrying member. This is particularly preferred in order to rearrange the toner and reproduce images faithfully to latent images on the latent image bearing member.

Stated specifically, the image forming method may comprise forming in the developing zone, at least once between the latent image bearing member and the developer carrying member, an electric field in which the toner is directed from the latent image bearing member toward the developer carrying member and an electric field in which the toner is directed from the developer carrying member toward the latent image bearing member, and thereafter forming for a given time an electric field in which the toner is directed from the developer carrying member toward the latent image bearing member in an image area of the latent image bearing member and an electric field in which the toner is directed from the latent image bearing member toward the developer carrying member in a non-image area of the latent image bearing member, to develop a latent image held on the latent image bearing member, using the toner of the two component type developer carried on the developer carrying member, where the time ($T_2$) for forming the electric field in which the toner is directed from the developer carrying member toward the latent image bearing member in an image area of the latent image bearing member and the electric field in which the toner is directed from the latent image bearing member toward the developer carrying member in a non-image area of the latent image bearing member may preferably be made longer than the total time ($T_1$) for forming the electric field in which the toner is directed from the latent image bearing member toward the developer carrying member and the electric field in which the toner is directed from the developer carrying member toward the latent image bearing member.

The carrier adhesion may more hardly occur when development is carried out in the presence of a developing electric field where alternation is periodically made off in the developing process in which development is carried out while forming the above specific developing electric field, i.e., an alternating electric field. The reason therefor is still unclear, and is presumed as follows:

In conventional continuous sinusoidal or rectangular waves, when an electric field intensity is made higher in an attempt to achieve a higher image quality and density, toner and carrier join to reciprocate between the latent image bearing member and the developer carrying member, so that the carrier strongly rubs against the latent image bearing member to cause the carrier adhesion. This more remarkably tends to occur with an increase in the fine powder carrier.

However, the application of the specific alternating electric field as in the present invention causes the toner or the carrier to reciprocate between the developer carrying member and the latent image bearing member in an incomplete reciprocation under one pulse. Hence, after that, in the case when a potential difference $V_{cont}$ between the surface potential of the latent image bearing member and the potential of a direct current component of a developing bias is $V_{cont}<0$, the direct current component acts in the manner that it causes the carrier to fly from the developer carrying member. However, the carrier adhesion can be prevented by controlling magnetic properties of the carrier and magnetic flux density in the developing zone of a magnet roller. In the case of $V_{cont}>0$, the force of a magnetic field and the direct current component act in the manner that they attract the carrier to the side of the developer carrying member, where no carrier adhesion occurs.

Figure 6:
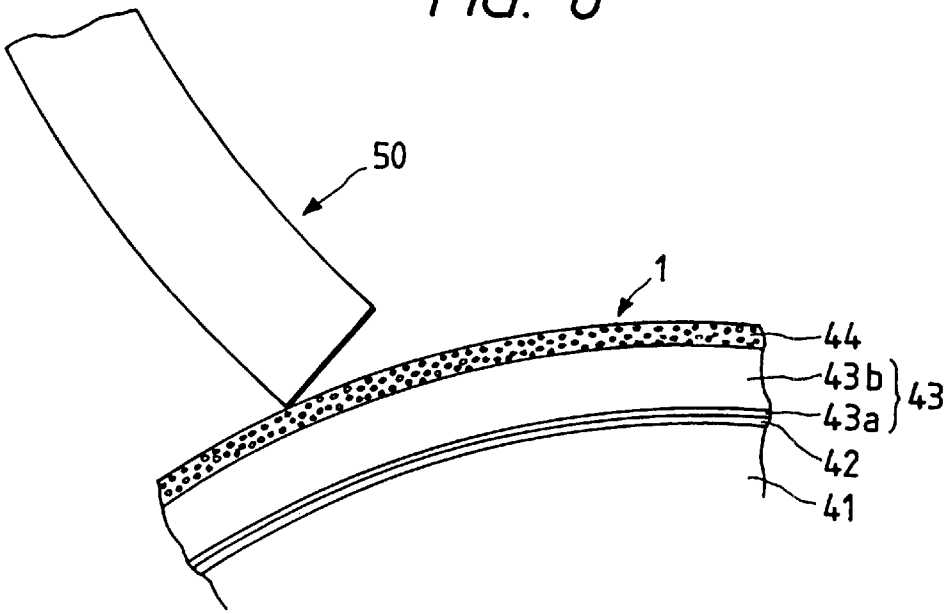
FIG. 6 illustrates a preferred electrostatic latent image bearing member that can be used in the image forming method of the present invention.

A preferred embodiment of the electrostatic latent image bearing member that can be used in the image forming method of the present invention will be described with reference to FIG. 6.

In this embodiment, an electrostatic latent image bearing member 1 comprises a conductive support 41 and provided thereon a photosensitive layer 43 and a protective layer 44. At least the protective layer 44 contains fluorine-containing resin particles so that the frictional resistance on the surface of the electrostatic latent image bearing member 1 can be decreased. The protective layer 44 is also mechanically abraded. The protective layer 44 may preferably have an average surface roughness of from 0.01 to 1.5 μm, indicated by 10-point average surface roughness Rz as prescribed in JIS B061 (hereinafter abridged "average surface roughness").

When this average surface roughness is within the above range, the friction between the cleaning blade 50 and the surface of the electrostatic latent image bearing member 1 can be sufficiently small and also no faulty images can occur even after repeated use, also bringing about a very good highlight reproduction.

The fluorine-containing fine resin particles that can effectively decrease the coefficient of friction on the surface of the electrostatic latent image bearing member 1 may be in a content of from 5 to 40% by weight, and preferably from 10 to 40% by weight, in the protective layer 44, based on the total weight of the protective layer 44. The protective layer 44 may preferably have a layer thickness in the range of from 0.05 μm to 8.0 μm, and more preferably in the range of from 0.1 μm to 6.0 μm.

In the present invention, in the case when the fluorine-containing fine resin particles are also contained in the part of the photosensitive layer 43, the content of such fine particles is limited since the photosensitive layer 43 has a larger thickness than the thin-layer protective layer 44. Stated specifically, their content in the photosensitive layer 43 may preferably be not more than 10% by weight, and more preferably not more than 7% by weight, based on the total weight of the photosensitive layer 43.

Even though the content of the fluorine-containing fine resin particles in the photosensitive layer 43 is limited, a deterioration of sensitivity and a lowering of image uniformity may extremely occur because of scattering of light when the photosensitive layer 43 is thick in total thickness, in particular, when photocarriers are mainly generated on the support side of the photosensitive layer 43. On the other hand, an excessively thin photosensitive layer 43 may also cause a decrease in sensitivity or a lowering of chargeability because of an increase in capacitance of the photosensitive layer 43. Besides, it is not preferable to make the photosensitive layer 43 so extremely thick even when such fine particles are not contained in the photosensitive layer 43. The reason therefor is that the protective layer 44 serves as a light-scattering layer since the protective layer 44 containing such fine particles is laminated onto the photosensitive layer 43, so that, especially when photocarriers are mainly generated on the support side of the photosensitive layer 43, the light path of the light having been scattered becomes longer as the photocarrier generating portion is farther from the light-scattering layer, i.e., as the photosensitive layer 43 has a larger thickness, resulting in a great influence from the scattering of light.

Accordingly, the photosensitive layer 43 may preferably have a thickness of from 10 to 35 μm, and more preferably from 15 to 30 μm, in total, including the thickness of the protective layer 44. The fluorine-containing fine resin particles which may be contained in the photosensitive layer 43 should preferably be in an amount as small as possible. Thus, such fine particles in the layer with a thickness corresponding to the total of the photosensitive layer 43 and protective layer 44 should be in an average content of not more than 17.5% by weight based on the total weight of the photosensitive layer 43 and protective layer 44.

In the present invention, the fluorine-containing fine resin particles used in the electrostatic latent image bearing member are comprised of one or more materials selected from polytetrafluoroethylene, polychlorotrifluoroethylene, polyvinylidene fluoride, polydichlorodifluoroethylene, a tetrafluoroethylene/perfluoroalkyl vinyl ether copolymer, a tetrafluoroethylene/hexafluoropropylene copolymer, a tetrafluoroethylene/ethylene copolymer and a tetrafluoroethylene/hexafluoropropylene/perfluoroalkyl vinyl ether copolymer. Commercially available fluorine-containing fine resin particles can be used as they are. Those having a molecular weight of from 3,000 to 5,000,000 can be used, and those having a particle diameter of from 0.01 to 10 $\mu$m, and preferably from 0.05 to 2.0 $\mu$m, can be used.

The photosensitive layer 43 of the electrostatic latent image bearing member of the present invention contains at least a charge-generating material and a charge-transporting material as organic photoconductive materials.

The charge-generating material may include, for example, phthalocyanine pigments, polycyclic quinone pigments, trisazo pigments, disazo pigments, azo pigments, perylene pigments, indigo pigments, quinacridone pigments, azulenium salt dyes, squarilium dyes, cyanine dyes, pyrylium dyes, thiopyrylium dyes, xanthene coloring matter, quinoneimine coloring matter, triphenylmethane coloring matter, styryl coloring matter, selenium, a selenium-tellurium alloy, amorphous silicon and cadmium sulfide.

The charge-transporting material may include, for example, pyrene compounds, N-alkylcarbazole compounds, hydrazone compounds, N,N-dialkylaniline compounds, diphenylamine compounds, triphenylamine compounds, triphenylmethane compounds, pyrazoline compounds, styryl compounds, stilbene compounds, polynitro compounds, polycyano compounds, and also pendant polymers comprising any of these compounds fixed on polymers.

In many instances, the above fluorine-containing fine resin particles, charge-generating material and charge-transporting material are dispersed and incorporated into binder resins having film forming properties to respectively form the protective layer and the photosensitive layer. Such binder resins may include polyesters, polyurethanes, polyacrylates, polyethylene, polystyrene, polybutadiene, polycarbonates, polyamides, polypropylene, polyimides, phenol resins, acrylic resins, silicone resins, epoxy resins, urea resins, allyl resins, alkyd resins, polyamide-imide, nylons, polysulfone, polyallyl ethers, polyacetals and butyral resins.

The layer structure of the electrostatic latent image bearing member will be described below. The conductive support 41 may be made of a metal such as iron, copper, gold, silver, aluminum, zinc, titanium, lead, nickel, tin, antimony or indium or an alloy thereof, an oxide of any of these metals, carbon, or a conductive polymer. It may have the shape of a drum such as a cylinder or a column, a belt, or a sheet. The above conductive materials may be molded as they are, may be used in the form of coating materials, may be vacuum-deposited, or may be processed by etching or plasma treatment. In the case of coating materials, not only the above metal and alloy but also paper and plastic are used as the support.

The photosensitive layer 43 in the electrostatic latent image bearing member 1 may be of either single-layer structure or laminated structure. In the case of the laminated structure, the layer is comprised of at least a charge generation layer 43*a* and a charge transport layer 43*b*. The charge polarity and the polarity of toner used differ between the case when the charge generation layer 43*a* is provided on the side of the conductive support 41 and the case when the charge transport layer 43*b* is provided on that side. The charge generation layer 43*a* may preferably have a layer thickness of from 0.001 to 6 $\mu$m, and more preferably from 0.01 to 2 $\mu$m. The charge-generating material contained in the charge generation layer 43*a* may preferably be in a content of from 10 to 100% by weight, and more preferably from 50 to 100% by weight, based on the total weight of the charge generation layer. The charge transport layer 43*b* has a thickness obtained by subtracting the layer thickness of the charge generation layer 43*a* from the photosensitive layer 43. The charge-transporting material contained in the charge transport layer 43*b* may preferably be in a content of from 20 to 80% by weight, and more preferably from 30 to 70% by weight, based on the total weight of the charge transport layer 43*b*.

A subbing layer 42 may be provided between the conductive support 41 and the photosensitive layer 43. The subbing layer 42 controls charge injection at the interface or functions as an adhesive layer. The subbing layer 42 is mainly composed of a binder resin. It may also contain the above metal or alloy described above, an oxide or salt thereof, a surface active agent, etc. As the binder resin that forms the subbing layer 42, those enumerated as the binder resins of the photosensitive layer 43 can be used. The subbing layer may preferably have a layer thickness of from 0.05 to 7 $\mu$m, and more preferably from 0.1 to 2 $\mu$m.

The protective layer may preferably be provided on the photosensitive layer as previously described, and be comprised of at least the fine resin particles containing fluorine atoms in a high concentration and the binder resin.

The electrostatic latent image bearing member can be produced using processes such as vacuum deposition and coating. When produced by coating, films can be formed in a wide range of from thin films to thick films and also in a variety of compositions. Stated specifically, the coating is carried out using a coating process such as bar coating, knife coating, dip coating, spray coating, beam coating, electrostatic coating, roll coating, attritor coating and powder coating.

The coating material used to form the protective layer can be obtained by dispersing the fluorine-containing fine resin particles in the binder resin and a solvent. The dispersion is carried out by means of a ball mill, an ultrasonic, a paint shaker, a red devil or a sand mill. The same dispersion method can also be used in the cases of conductive fine powder, pigment, and charge-generating materials comprising a pigment.

An image forming system that can carry out the image forming method of the present invention will be described with reference to FIG. 1.

As shown in FIG. 1, the image forming system comprises a photosensitive drum 1 serving as the electrostatic latent image bearing member, and a developing assembly 4 in which the inside of a developing container 16 is partitioned into a developing chamber (first chamber) R1 and an agitator chamber (second chamber) R2 by a partition wall 17. At the upper part of the agitator chamber R2, a toner storage chamber R3 is formed on the other side of the partition wall 17. A developer 19 is held in the developing chamber R1 and agitator chamber R2, and a replenishing toner (non-magnetic toner) 18 is held in the toner storage chamber R3. The toner storage chamber R3 is provided with a supply opening 20 so that the replenishing toner 18 is dropwise supplied through the supply opening 20 into the agitator chamber R2 in the quantity corresponding to the toner consumed.

A transport screw 13 is provided in the developing chamber R1. As the transport screw 13 is rotatingly driven, the developer 19 held in the developing chamber R1 is transported in the longitudinal direction of a developing sleeve 11. Similarly, a transport screw 14 is provided in the agitator chamber R2 and, as a transport screw 14 is rotated, the toner having dropped from the supply opening 20 into the agitator chamber R2 is transported in the longitudinal direction of the developing sleeve 11.

The developer 19 is a two component type developer comprising a non-magnetic toner and a magnetic carrier.

The developing container 16 is provided with an opening at its part adjacent to the photosensitive drum 1, and the developing sleeve 11 protrudes outward from the opening, where a gap is formed between the developing sleeve 11 and the photosensitive drum 1. The developing sleeve 11, formed of a non-magnetic material, is provided with a bias applying means 30 for applying a bias voltage.

The magnet roller serving as a magnetic field generating means fixed inside the developing sleeve 11, that is, a magnet 12 has a developing magnetic pole S2, a magnetic pole N2 positioned at its downstream, and magnetic poles N3, S1 and N1 for transporting the developer 19. The magnet 12 is provided in the developing sleeve 11 in such a way that the developing magnetic pole S2 faces the photosensitive drum 1. The developing magnetic pole S2 forms a magnetic field in the vicinity of a developing zone defined between the developing sleeve 11 and the photosensitive drum 1, where a magnetic brush is formed by the magnetic field.

A developer regulating blade 15 provided above the developing sleeve 11 to control the layer thickness of the developer 19 on the developing sleeve 11 is a non-magnetic blade 15 made of a non-magnetic material such as aluminum or SUS 316 stainless steel, and the distance between its end and the face of the developing sleeve 11 is 300 to 1,000 $\mu$m, and preferably 400 to 900 $\mu$m. If this distance is smaller than 300 $\mu$m, the magnetic carrier may be caught between them to tend to make the developing layer uneven, and at the same time the developer necessary for carrying out good development can not be coated on the sleeve, bringing about the problem that only developed images with a low density and much unevenness can be obtained. In order to prevent uneven coating (what is called the blade clog) due to unauthorized particles included in the developer, the distance may preferably be 400 $\mu$m or larger. If it is more than 1,000 $\mu$m or larger, the quantity of the developer coated on the developing sleeve 11 increases to enable no desired regulation of the developer layer thickness, bringing about the problems that the magnetic carrier particles adhere to the photosensitive drum 1 in a large quantity and also the circulation of the developer and the control of the developer by the non-magnetic blade 15 may become ineffective to tend to cause fog because of a shortage of triboelectricity of the toner.

The angle $\theta 1$ is $-5°$ to $35°$, and preferably $0°$ to $25°$. In the case of $\theta 1 < -5°$, the developer thin layer formed by the magnetic force, reflection force, cohesive force and so forth that act on the developer may become sparse and much uneven. In the case of $\theta 1 > 35°$, the use of the non-magnetic blade causes an increase in the quantity of developer coating to make it difficult to obtain the desired quantity of developer.

This layer of magnetic carrier particles, even when the developing sleeve 11 is rotatingly driven in the direction of an arrow, moves slower as it separates from the sleeve surface in accordance with the balance between the binding force exerted by magnetic force and gravity and the transport force acting toward the transport of the sleeve 11. Of course, some particles drop by the effect of gravity.

Accordingly, the position to arrange the magnetic poles N1 and N2 and the fluidity and magnetic properties of the magnetic carrier particles may be appropriately selected, so that the magnetic carrier particle layer is transported toward the magnetic pole N1 as it stands nearer to the sleeve, to form a moving layer. Along this movement of the magnetic carrier particles, the developer is transported to the developing zone as the developing sleeve 11 is rotated, and participates in development. Reference numeral 21 denotes an upstream side toner scatter preventive member, and 22, a downstream side toner scatter preventive member. These upstream side toner scatter preventive member 21 and downstream side toner scatter preventive member 22 prevent the toner from scattering.

Another example of the image forming system that can carry out the image forming method of the present invention will be described below with reference to FIG. 7.

Figure 7:
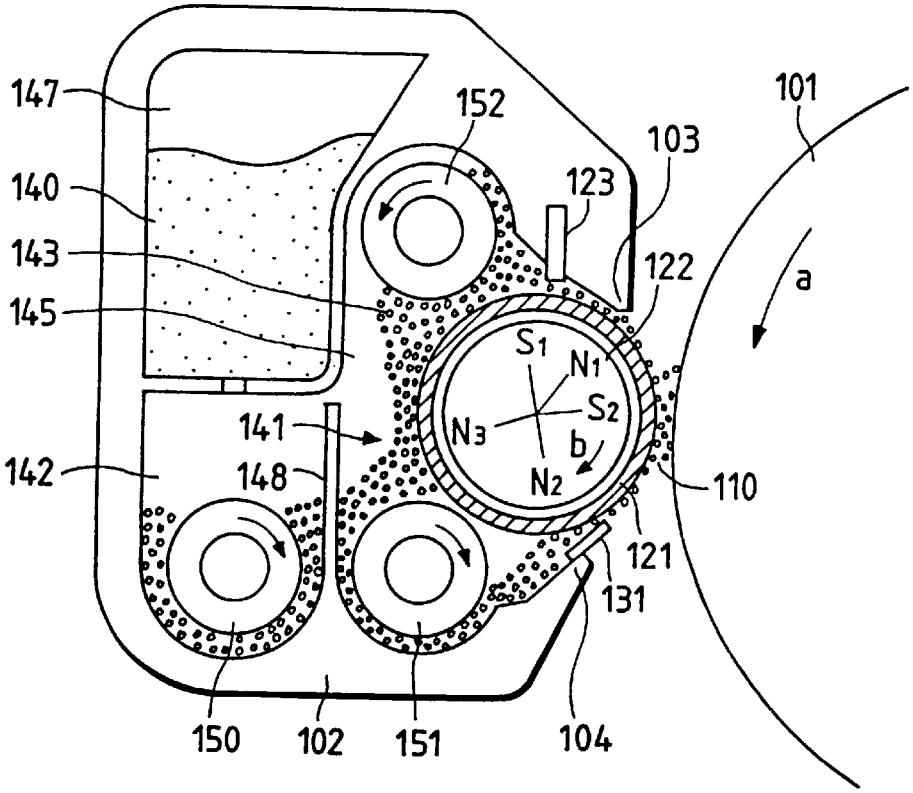
FIG. 7 illustrates another image forming system used in the image forming method of the present invention.

The developing system as shown in FIG. 7 comprises a developing container 102 receiving a developing chamber 145 having therein a non-magnetic developing sleeve (developer carrying member) 121 serving as the developer carrying member, which is provided opposingly to an electrostatic latent image bearing member 101 rotatable in the direction of an arrow a. In this developing sleeve 121, a magnetic roller 122 as a magnetic field generating means is left to stand stationary, and the magnetic (magnet) roller 122 is magnetized to have magnetic poles in the order of S1, N1, S2, N2 and N3 from substantially the top position thereof in the rotational direction of an arrow b.

The developing chamber 145 holds therein a two component type developer 141 comprising a blend of a toner 140 with a magnetic carrier 143.

This developer 141 is sent to the inside of an agitator chamber 142 of the developing container 102 through one opening (not shown) made in a partition wall 148 whose upper end is open at one end of the developing chamber 145, where the toner 140 having been fed into the agitator chamber 142 is supplied from a toner chamber 147 and is transported to the other end of the agitator chamber 142 while being blended by a first developer agitating-transporting means 150. The developer 141 having been transported to the other end of the agitator chamber 142 is sent to the inside of the developing chamber 145 through the other opening (not shown) made in the partition wall 148, and then fed onto the developing sleeve 121 while being agitated and transported by a second developer agitating-transporting means 151 in the developing chamber 145 and a third developer agitating-transporting means 152 for transporting the developer at the upper part in the developing chamber 145 in the direction reverse to the direction in which the developer is transported by the transporting means 151.

The developer 141 fed onto the developing sleeve 121 is magnetically bound thereto by the action of a magnetic force of the magnetic roller 122, and thus carried on the developing sleeve 121. Then the developer is, while being formed into a thin layer of the developer 141 on the developing sleeve 121 by the regulation of a developer regulating blade 123 provided substantially above the top of the developing sleeve 121, transported to a developing zone 110 opposing to the electrostatic latent image bearing member 101, as the developing sleeve 121 is rotated in the direction of the arrow b, where the developer is used for the development of the latent image formed on the electrostatic latent image bearing member 101. Remaining two component type developer 141 not consumed for the development is returned to the developing container 102 as the developing sleeve 121 is rotated.

Reference numeral 103 denotes an upstream side toner scatter preventive member, and 104, a downstream side toner scatter preventive member. These upstream side toner scatter preventive member 103 and downstream side toner scatter preventive member 104 prevent the toner from scattering.

In the developing container 102, the remaining two component type developer 141 not consumed for the development, magnetically bound onto the developing sleeve 121, is so designed that it is taken off by a repulsive magnetic field formed across N2 and N3 having the same polarity. In order to prevent toner scatter from occurring when the two component type developer 141 rises in ears along the line of magnetic force by the action of the magnetic pole N2, an elastic seal member 131 is provided stationarily at the lower part of the developing container 102 in such a manner that its one end comes in touch with the two component type developer 141.

The present inventors also made extensive studies on image density, highlight reproduction and fine-line reproduction in a color image forming method. As a result, they have discovered that a higher image quality with a high image density and superior highlight reproduction and fine-line reproduction can be achieved when the toner having the specific particle size distribution as described below is used in the image forming method making use of the developing process in which the specific developing electric field as previously described.

More specifically, the toner used in the present invention may preferably contain at least toner particles and an external additive; have a weight average particle diameter of from 3 $\mu$m to 7 $\mu$m; and contain more than 40% by number of toner particles with particle diameters of 5.04 $\mu$m or smaller, from 10% to 70% by number of toner particles with particle diameters of 4 $\mu$m or smaller, from 2% to 20% by volume of toner particles with particle diameters of 8 $\mu$m or larger, and 0 to 6% by volume of toner particles with particle diameters of 10.08 $\mu$m or larger.

The toner having the above particle size distribution enables faithful reproduction of the latent images formed on the photosensitive member and also enables good reproduction of minute dot latent images such as halftone dots and digital images, so that it can particularly provide images with superior highlight reproduction and resolution. Moreover, such a toner can maintain a high image quality even when copying or printing-out is continued, and also can promise good development carried out at a smaller toner consumption than conventional non-magnetic toners even in the case of images with a high density, bringing about not only economical advantages but also advantages for making the bodies of copying machines or printers smaller in size.

In conventional continuous sinusoidal waves or rectangular waves, however, even if the toner can achieve a good latent image reproduction, latent images having a small development contrast, such as highlight latent images, have originally no sufficient electric field intensity. Hence, under continuous pulses, the proportion in which the toner does not reach the electrostatic latent image bearing member becomes larger. Namely, in a bias applied under such conditions, the toner moves vibrationally in such a manner that it does not reach the electrostatic latent image bearing member from the developer carrying member.

However, in the present invention, the formation of a specific developing electric field as previously described makes it possible to obtain good highlight images free of coarse images. That is, under one pulse, the toner similarly reciprocates between the developer carrying member and the electrostatic latent image bearing member in an incomplete reciprocation, but, after that, in the case when a potential difference $V_{cont}$ between the surface potential of the electrostatic latent image bearing member and the potential of a direct current component of a developing bias is $V_{cont}<0$, the direct current component acts in the manner that it attracts the toner to the side of the developer carrying member, so that the toner is one-sided on the side of the developer carrying member. In the case of $V_{cont}>0$, on the other hand, the direct current component acts in accordance with a latent image potential, in the manner that it attracts the toner to the side of the electrostatic latent image bearing member, so that the toner in a quantity corresponding to the latent image potential is one-sided on the side of the electrostatic latent image bearing member. When development is carried out under such conditions, the toner having reached the surface of the electrostatic latent image bearing member repeats vibrations there until it concentrates in latent image areas. Hence, the shapes of dots are made uniform to make it possible to obtain good images free of unevenness.

Thus, the conversion of latent images into visible images in a development bias applied under the above conditions causes no blanks of dots even in the case of highlight latent images. Moreover, the toner repeating vibrations on the electrostatic latent image bearing member causes itself to concentrate in the latent image areas, so that every dot can be faithfully reproduced and, in the two component type developer, halftone images free of any irregularities ascribable to the state of contact of the magnetic brush can be outputted.

Measuring methods used in the present invention will be described below.

(1) Measurement of Magnetic Properties of Carrier

A BHU-60 type magnetization measuring device (manufactured by Riken Sokutei Co.) is used as a device. About 1.0 g of a sample for measurement is weighed and packed in a cell of 7 mm inner diameter and 10 mm high, which is then set in the above device. Measurement is made while gradually increasing an applied magnetic field to be changed to 3,000 oersted at maximum. Subsequently, the applied magnetic field is decreased, and finally a hysteresis curve of the sample is obtained on a recording paper. Saturation magnetization, residual magnetization and coercive force are determined therefrom.

(2) Measurement of Particle Size Distribution of Carrier

An SRA type microtrack particle size analyzer (manufactured by Nikkiso K.K.) is used as a device. Measurement range is set at from 0.7 to 125 $\mu$m.

(3) Measurement of Electrical Resistance of Carrier Particles

Figure 8:
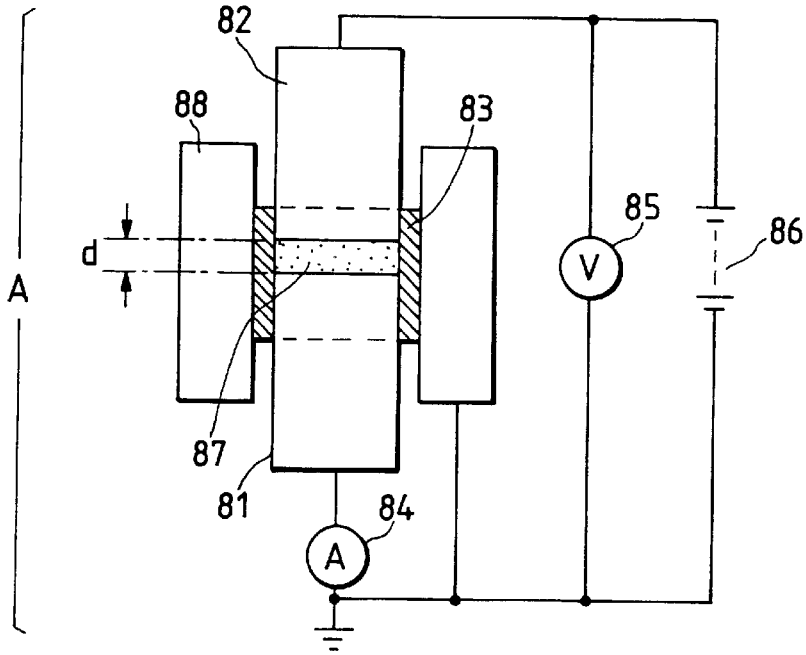
FIG. 8 is a diagrammatic view to illustrate a device for measuring electrical resistance.

The value of electrical resistance of carrier particles is measured using a cell shown in FIG. 8. More specifically, carrier particles are packed in a cell A and electrodes 81 and 82 are so provided as to come into contact with the packed carrier particles, where a 2 kHz sinusoidal AC voltage is applied across the electrodes and the AC currents flowing at that time are measured to determine resistivity. The measurement is made under conditions of contact area S between the packed carrier particles and the cell; 2 $cm^2$; thickness d: 3 mm; load of the upper electrode: 15 kg; and applied voltage Vpp: 100 V.

In FIG. 8, reference numeral 83 denotes an insulating material; 84, an ammeter; 85, a voltmeter; 86, a voltage stabilizer; 87, carrier particles; and 88, a guide ring.

(4) Measurement of Particle Size Distribution (Weight Average Particle Diameter) of Toner The average particle diameter and particle size distribution of the toner can be measured using a COULTER counter Model TA-II or COULTER MULTISIZER (manufactured by Coulter Electronics, Inc.). In the present invention, COULTER MULTISIZER (manufactured by Coulter Electronics, Inc.) is used. An interface (manufactured by Nikkaki k.k.) that outputs number distribution and volume distribution and a personal computer PC9801 (manufactured by NEC) are connected. As an electrolytic solution, an aqueous 1% NaCl solution is prepared using first-grade sodium chloride. For example, ISOTON R-II (Coulter Scientific Japan Co.) may be used. Measurement is carried out by adding as a dispersant from 0.1 to 5 ml of a surface active agent, preferably an alkylbenzene sulfonate, to from 100 to 150 ml of the above aqueous electrolytic solution, and further adding from 2 to 20 mg of a sample to be measured. The electrolytic solution in which the sample has been suspended is subjected to dispersion for about 1 minute to about 3 minutes in an ultrasonic dispersion machine. The volume distribution and number distribution are calculated by measuring the volume and number of toner particles with diameters of not smaller than 2 $\mu$m by means of the above COULTER MULTISIZER, using an aperture of 100 $\mu$m as its aperture. Then the values according to the present invention are determined, which are the volume-based, volume-average particle diameter (DV: the middle value of each channel is used as the representative value for each channel) and the weight-based, weight average particle diameter (D4) determined from the volume distribution, the number-based, length average particle diameter (D1) determined from number distribution, and the volume-based, percentage of particles (8.00 $\mu$m or larger and 3.17 $\mu$m or smaller) determined from the volume distribution and the number-based, percentage of particles (5 $\mu$m or smaller and 3.17 $\mu$m or smaller) determined from the number distribution.

(5) Measurement of Number Average Particle Diameter of External Additive (Inorganic Fine Powder)

To know the number average particle diameter of the external additive on toner particles, particles are observed on a scanning electron microscope at 50,000 magnifications, and 100 particles in the visual field are qualitatively analyzed by means of an X-ray microanalyzer (XMA). Then, their particle diameters are measured to determine the number average particle diameter.

(6) Measurement of Hydrophobicity of Inorganic Fine Powder

Methanol titration is an experimental means for ascertaining the hydrophobicity of inorganic fine powder whose particle surfaces have been made hydrophobic.

"Methanol titration" as defined in the present specification for evaluating the hydrophobicity of the treated inorganic fine powder is carried out in the following way: 0.2 g of inorganic fine powder to be tested are added to 50 ml of water contained in an Erlenmeyer flask with a volume of 250 ml. Methanol is dropwise added from a buret until the whole inorganic fine powder has been swelled. Here, the solution inside the flask is continually stirred by means of a magnetic stirrer. The end point can be observed upon suspension of the whole inorganic fine powder in the solution. The hydrophobicity is expressed as a percentage of the methanol present in the liquid mixture of methanol and water when the reaction has reached the end point.

(7) Measurement of Light Transmittance

| | |
|---|---|
| 1) Sample | 0.10 g |
| Alkyd resin (BECKOSOL 1323-60-EL, available from Dainippon Ink & Chemicals, Incorporated) | 13.20 g |
| Melamine resin (SUPER BECKAMIN J-820-60, available from Dainippon Ink & Chemicals, Incorporated) | 3.30 g |
| Thinner (ALAMICK THINNER, available from Kansai Paint Co., Ltd.) | 3.50 g |
| Glass media | 50.00 g |

Materials with the above composition are collected in a 150 cc glass bottle, and dispersion is carried out for 1 hour using a paint conditioner manufactured by Red Devil Co.

2) After the dispersion has been completed, the dispersed product is coated on a PET film by means of a doctor blade set at a distance of 2 mm from the surface of the PET film.
3) The coating formed in the step 2) is heated at 120° C. for 10 minutes to carry out baking.
4) The sheet obtained in the step 3) is set on U-BEST 50, manufactured by Nihon Bunkou Co., to measure its light transmittance in the range of 320 to 800 nm.

(8) Measurement of Specific Surface Area

Measured according to the following procedure, using a powder specific surface area measuring device manufactured by Shimadzu Corporation (Model SS-100).

1) To fill a powder tester with a sample iron powder, the power source of its autosliduck is put on and the voltage is adjusted to 100 V.
2) The powder tester is switched to tapping, and its timer is adjusted to 1 minute (50 times plus-minus 1 time per minute).
3) A sieve plate is put in a sample cylinder made of plastic, and then a sheet of filter paper is put down on the plate, on which the sample is put by ⅓ of the sample cylinder.
4) The sample cylinder is set on a tapping stand of the powder tester, and the starting button is set on (tapping for 1 minute).
5) In the sample cylinder thus tapped, the sample is further put by ⅔ of the sample cylinder.
6) The same operation as the item 4 is repeated.
7) A sub-cylinder made of plastic is inserted to the top of the sample cylinder, and the sample is heaped from the top thereof.
8) The same operation as the item 4 or the item 6 is repeated.
9) From the sample cylinder thus tapped, the sub-cylinder is pulled out, and the remaining excess sample is cut with a spatula.
10) A specific surface area measuring tube is filled with water up to the mark S.
11) The sample cylinder is connected to the measuring tube. (After packed with the sample, grease is applied to the fitting surfaces.)
12) A cock of an outlet at the lower part is opened, and a stopwatch is started at the time the water surface in the measuring tube passes the mark 0. (The water flowed out at the lower part is received in a beaker.)
13) Time for which the water surface drops to the mark 20 (unit: cc) is measured.
14) The sample cylinder is detached to measure the weight of the sample.
15) The specific surface area is calculated according to the following expression.

$$SW = \frac{14}{\rho}\sqrt{\frac{\Delta PAT}{\eta LQ}\cdot\frac{\varepsilon^3}{(1-\varepsilon)^2}}$$

$$\varepsilon = 1 - W/\rho AL$$

wherein;

SW is a specific surface area of powder ($cm^2/g$);

$\epsilon$ is a void of the sample-packed layer;

$\rho$ is a density of powder ($g/cm^3$);

$\eta$ is a coefficient of viscosity of the fluid (g/cm·sec);

L is a thickness of the sample layer (cm);

Q is a quantity of the fluid having permeated the sample layer (cc);

$\Delta P$ is a pressure difference between both ends of the sample layer ($g/cm^2$);

A is a sectional area of the sample layer ($cm^2$);

T is a time taken for Q cc of fluid (air) to permeate the sample layer (sec); and W is a weight of the sample (g).

(9) Measurement of Acid Value

In a 200 to 300 ml Erlenmeyer flask, 2 to 10 g of a sample is weighed and put, followed by addition of about 50 ml of a 30:70 mixed solvent of methanol and toluene to dissolve the sample. If it can not be well dissolved, acetone may be added in a small amount. Using a 0.1% mixed reagent of Bromothymol Blue and Phenol Red, titration is made in N/10 potassium hydroxide-alcohol solution previously standardized, and the acid value is calculated from the consumption of the alcohol potassium hydroxide solution according the following expression.

Acid value=KOH (ml number)×N×56.1/sample weight wherein N represents a factor of N/10 KOH.

(10) Glass Transition Temperature Tg

In the present invention, this is measured using a differential scanning calorimeter (DSC measuring device), DSC-7 (manufactured by Perkin-Elmer Inc.).

A sample to be measured is precisely weighed in a quantity of 5 to 20 mg, and preferably 10 mg.

This sample is put in an aluminum pan. Using an empty aluminum pan as a reference, the measurement is made in an environment of normal temperature and normal humidity at a measuring temperature range between 30° C. and 200° C., raised at a rate of 10° C./min.

During this temperature rise, an endothermic peak of the main peak in the range of temperatures 40° C. to 100° C. is obtained. The point at which the line at a middle point of the base lines before and after appearance of this endothermic peak and the differential thermal curve intersect is regarded as the glass transition temperature Tg.

(11) Measurement of Softening Temperature (Tm)

A flow tester CFT-500 Type (manufactured by Shimadzu Corporation) is used. A sample is weighed out from a 60 mesh-pass product in an amount of about 1.0 g. The sample is pressed for 1 minute using a molder under a load of 100 $kg/cm^2$.

The resulting pressed sample is measured under conditions shown below, using the flow tester in an environment of normal temperature and normal humidity (temperature: about 20–30° C.; humidity: 30–70% RH) to obtain a humidity-apparent viscosity curve. From the smooth curve thus obtained, the temperature ($T_{1/2}$) at the time the sample has flowed out by 50% by volume is determined, and the resulting value is regarded as softening temperature (Tm).

Rate of temperature rise: 6.0 D/M (° C./min)
Set temperature: 50.0 DEG (° C.)
Maximum temperature: 180.0 DEG (° C.)
Interval: 3.0 DEG (° C.)
Preheating: 300.0 SEC (seconds)
Load: 20.0 KGF (kg)
Die diameter: 1.0 MM (mm)
Die length: 1.0 MM (mm)
Plunger: 1.0 $CM^2$ ($cm^2$)

In the present invention, the carrier comprised of the magnetic ferrite particles formed of the specific ferrite component makes it possible to maintain the balance of characteristics of electrical resistance, saturation magnetization and charge quantity in proper ranges. Hence, the initial-stage performance concerning image quality, charge quantity and so forth can be maintained over a long period of time without their damage as a result of running. Especially when the carrier is used in combination with the fine-particle toner having small particle diameters, images with less fog, high image density and very high minuteness can be obtained throughout the initial stage and the running, and thereafter.

EXAMPLES

The invention is illustrated in more detail by reference to the following examples wherein, unless otherwise indicated, all percentages and parts are by weight.

Carrier Preparation Example 1

$Fe_2O_3$, MnO and $Na_2$ as an additive were each weighed so as to be in the ferrite component molar fraction as shown in Table 1, and were mixed by means of a ball mill. The resulting mixture powder was calcined at about 900° C., followed by pulverization. After the pulverization, the particle diameters of the pulverized particles were measured by the air permeability method to reveal that they had an average particle diameter of about 2.0 $\mu$m. Subsequently, to the pulverised particles, an aqueous solution of PVA (polyvinyl alcohol) (0.5–5.0% by weight of PVA) was added as a binder to carry out granulation by means of a spray drier.

The granulated powder obtained was fired at 1,100 to 1,300° C., and then pulverized, followed by classification to obtain carrier particles with a desired particle size.

To coat the surfaces of the resulting carrier particles with resin coat layers, a curable silicone resin material for forming the coat layers was dissolved in xylene to form a solution with 10% of solid content, and this coating solution was applied to the carrier particles, using a coater (SPIRA COATER, manufactured by Okada Seiko Co.), followed by drying to remove the solvent and then heating to obtain coated carrier 1.

Properties of the carrier 1 thus obtained are shown in Table 1.

Carrier Preparation Examples 2 to 14

Coated carriers 2 to 12 were prepared in the same manner as in Carrier Preparation Example 1 but changing the composition and molar fraction of the ferrite component and the resin coat layer as shown in Table 1.

When the resin material used for the resin coat layers to coat the carrier particle surfaces is silicone resin, xylene was used as the solvent. In the case of polytetrafluoroethylene/polyvinylidene fluoride (PTEF/PVDF=5/5), methyl ethyl ketone was used as the solvent.

Properties of the coated carriers 2 to 14 thus obtained are shown in Table 1.

TABLE 1

| Carrier | | Ferrite component composition (mol %) | | | | Weight average particle diameter | | (Coating weight) | Electrical resistance | Saturation magnetization |
|---|---|---|---|---|---|---|---|---|---|---|
| | No. | $Fe_2O_3$ | MnO | Additive | | ($\mu$m) | Resin coat layer | (wt. %) | ($\Omega \cdot$ cm) | ($Am^2/kg$) |
| Example: | | | | | | | | | | |
| 1 | 1 | 60 | 30 | $Na_2O$, | 10 | 40 | Curable silicone resin | (2.0) | $2 \times 10^8$ | 60 |
| 2 | 2 | 60 | 30 | $Na_2O$, | 10 | 70 | Curable silicone resin | (1.0) | $1 \times 10^8$ | 60 |
| 3 | 3 | 60 | 24 | $K_2O$, | 16 | 40 | Curable silicone resin | (2.0) | $2 \times 10^8$ | 56 |
| 4 | 4 | 60 | 30 | $K_2O$, $Bi_2O_3$, | 8 2 | 40 | Curable silicone resin | (2.0) | $5 \times 10^9$ | 58 |
| 5 | 5 | 60 | 28 | CaO, | 12 | 40 | Curable silicone resin | (2.0) | $4 \times 10^7$ | 61 |
| 6 | 6 | 60 | 28 | CaO, | 12 | 40 | PTFE/PVDF(5/5) | (2.0) | $4 \times 10^7$ | 61 |
| 7 | 7 | 60 | 34 | SrO, | 6 | 40 | Curable silicone resin | (2.0) | $9 \times 10^6$ | 62 |
| Comparative Example: | | | | | | | | | | |
| 1 | 8 | 90 | 5 | CaO, | 5 | 40 | Curable silicone resin | (2.0) | $3 \times 10^9$ | 46 |
| 2 | 9 | 40 | 55 | $K_2O$, | 5 | 40 | Curable silicone resin | (2.0) | $8 \times 10^5$ | 60 |
| 3 | 10 | 70 | — | $Na_2O$, | 30 | 40 | Curable silicone resin | (2.0) | $7 \times 10^5$ | 52 |
| 4 | 11 | 70 | 30 | — | | 40 | Curable silicone resin | (2.0) | $9 \times 10^5$ | 63 |
| Example: | | | | | | | | | | |
| 10 | 12 | 60 | 27 | CaO, $Bi_2O_3$, | 8 5 | 40 | Curable silicone resin | (2.0) | $1 \times 10^{13}$ | 54 |
| Comparative Example: | | | | | | | | | | |
| 5 | 13 | 25 | 45 | $Na_2O$, | 30 | 40 | Curable silicone resin | (2.0) | $5 \times 10^5$ | 25 |
| 6 | 14 | 25 | 5 | $Na_2O$, | 70 | 40 | Curable silicone resin | (2.0) | $6 \times 10^7$ | 27 |

Toner Production Example 1

| | |
|---|---|
| Polyester resin obtained by condensation of propoxylated bisphenol and fumaric acid | 100 parts |
| Phthalocyanine pigment | 4 parts |
| Chromium complex of di-tert-butylsalicylic acid | 4 parts |

The above materials were thoroughly premixed by means of a Henschel mixer, and then melt-kneaded using a twin-screw extrusion kneader. After cooled, the kneaded product was crushed using a hammer mill to give coarse particles of about 1 to 2 mm in diameter, which were then finely pulverized using a fine grinding mill of an air-jet system. The resulting finely pulverized product was classified to obtain a negatively chargeable cyan color powder with a weight average particle diameter of 8.5 $\mu$m. To 100 parts by weight of the color powder, 1.0 part by weight of fine titanium oxide powder was added and mixed by means of a Henschel mixer to obtain cyan toner 1.

Toner Production Example 2

| | |
|---|---|
| Polyester resin obtained by condensation of propoxylated bisphenol and fumaric acid | 100 parts |
| Phthalocyanine pigment | 4 parts |
| Chromium complex of di-tert-butylsalicylic acid | 4 parts |

The above materials were thoroughly premixed by means of a Henschel mixer, and then melt-kneaded using a twin-screw extrusion kneader. After cooled, the kneaded product was crushed using a hammer mill to give coarse particles of about 1 to 2 mm in diameter, which were then finely pulverized using a fine grinding mill of an air-jet system. The resulting finely pulverized product was classified to obtain a negatively chargeable cyan color powder with a weight average particle diameter of 6.2 $\mu$m. To 100 parts by weight of the color powder, 1.3 part by weight of fine titanium oxide powder was added and mixed by means of a Henschel mixer to obtain cyan toner 2.

Example 1

Figure 3:
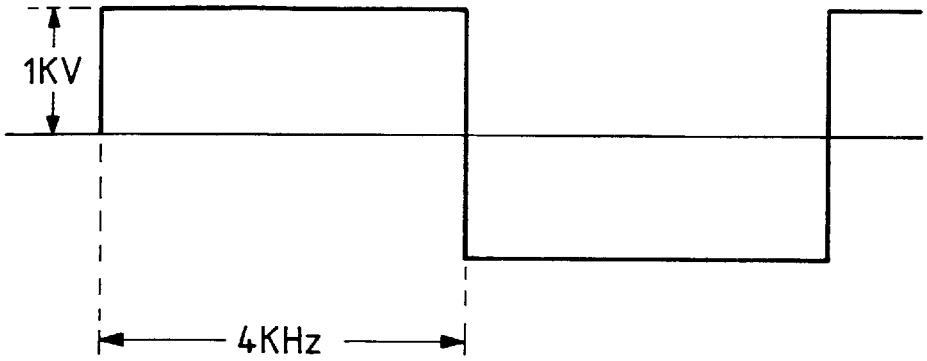
FIG. 3 shows a pattern of an alternating electric field used in Examples 1 to 10 and 31.

The cyan toner 1 obtained in Toner Production Example 1 and the carrier 1 were blended so as to be in a toner concentration of 8% to produce a two component type developer. Using the developer thus obtained and using a color copying machine CLC-500 (manufactured by Canon Inc.) which is the image forming system as shown in FIG. 1 and to which an alternating electric field as shown in FIG. 3 was applied, an original with an image area percentage of 5.0% was copied to reproduce images on 50,000 copy sheets in an environment of temperature 26° C. and humidity 60% RH.

Results obtained are shown in Table 2. As is seen from Table 2, the above two component type developer causes less variations in charge quantity, image quality and fog during the running test, has no problem on in-machine contamination after running on 50,000 sheets, and is very good.

Results obtained in the following Examples and Comparative Examples are also shown in Table 2.

Example 2

An experiment was made in the same manner as in Example 1 except for using the toner 1 and the carrier 2 and changing the toner concentration to 5%. As a result, although the image density after running on 50,000 sheets slightly decreased, there was no problem in practical use, and good results were obtained as shown in Table 2.

Example 3

An experiment was made in the same manner as in Example 1 except for using the toner 1 and the carrier 3. As a result, although the image density after running on 50,000 sheets slightly decreased, there was no problem in practical use, and good results were obtained as shown in Table 2.

Example 4

An experiment was made in the same manner as in Example 1 except for using the toner 2 and the carrier 4 and changing the toner concentration to 6%. As a result, very highly minute images were obtained in a high image density throughout the initial stage and the 50,000 sheet running and thereafter. There was also no problem at all on fog and in-machine contamination.

Examples 5 and 6

Experiments were made in the same manner as in Example 1 except for using the toner 1 in combination with the carriers 4 and 5, respectively. As a result, good results were obtained as shown in Table 2.

Examples 7 to 9

Experiments were made in the same manner as in Example 4 except for using the toner 2 in combination with the carriers 5 to 7, respectively. As a result, good results were obtained as shown in Table 2.

increase in fog and toner scatter was seen. This is presumably because the electrical resistance and charge quantity of carrier cores used were improper and hence, although the initial-stage performance was improved by the coat material, the electrical resistance and charge quantity of the carrier decreased with a deterioration of the coat layers during the running.

Comparative Examples 2 to 7

Experiments were made in the same manner as in Example 1 except for using the toner 1 in combination with the carriers 9 to 14, respectively. As a result, there was no problem on the initial-stage performance in all instances, but charge quantity decreased and fog increased, with an increase in the number of sheets in the running. Further, the in-machine contamination was seen. This is presumably because all the carriers had a poor balance between the electrical resistance, charge quantity and magnetic properties possessed by carrier cores and hence the performance required as carriers lowered with a deterioration of the coat materials.

TABLE 2

| | | | | Initial stage | | | After 50,000 sheet running | | | |
|---|---|---|---|---|---|---|---|---|---|---|
| | Carrier No. | Toner No. | Toner concentration (%) | Charge quantity (mC/kg) | Image quality | Fog | Charge quantity (mC/kg) | Image quality | Fog | Toner scatter |
| Example: | | | | | | | | | | |
| 1 | 1 | 1 | 8 | −28 | A | 1.1 | −28 | A | 1.2 | A |
| 2 | 2 | 1 | 5 | −29 | A | 1.1 | −26 | A | 1.2 | A |
| 3 | 3 | 1 | 8 | −28 | A | 1.2 | −27 | A | 1.4 | A |
| 4 | 3 | 2 | 6 | −31 | AA | 1.3 | −29 | AA | 1.5 | A |
| 5 | 4 | 1 | 8 | −27 | A | 1.2 | −27 | A | 1.3 | A |
| 6 | 5 | 1 | 8 | −28 | A | 1.1 | −27 | A | 1.3 | A |
| 7 | 5 | 2 | 6 | −30 | AA | 1.2 | −28 | AA | 1.4 | A |
| 8 | 6 | 2 | 6 | −29 | AA | 1.3 | −27 | AA | 1.4 | A |
| 9 | 7 | 2 | 6 | −32 | AA | 1.0 | −30 | AA | 1.1 | A |
| Comparative Example: | | | | | | | | | | |
| 1 | 8 | 1 | 8 | −27 | AB | 1.3 | −21 | B | 2.4 | B |
| 2 | 9 | 1 | 8 | −26 | A | 1.3 | −23 | AB | 2.1 | B |
| 3 | 10 | 1 | 8 | −30 | AB | 1.2 | −22 | B | 2.3 | B |
| 4 | 11 | 1 | 8 | −30 | A | 1.2 | −24 | AB | 2.0 | AB |
| Example: | | | | | | | | | | |
| 10 | 12 | 1 | 8 | −27 | A | 1.3 | −25 | A | 1.7 | A |
| Comparative Example: | | | | | | | | | | |
| 5 | 13 | 1 | 8 | −26 | — | 1.8 | Carrier adhered too seriously to continue running | | | |
| 6 | 14 | 1 | 8 | −15 | — | 2.3 | Carrier adhered too seriously to continue running | | | |

Comparative Example 1

An experiment was made in the same manner as in Example 1 except for using the toner 1 and the carrier 8. As a result, the image quality was at a little low level throughout the initial stage and the 50,000 sheet running and thereafter. This is presumably due to improper magnetic properties and an unpreferable form and density of the magnetic brush. There was no problem on charge quantity and fog at the initial stage but, after the 50,000 sheet running, the charge quantity decreased and in-machine contamination due to an Example 11

Figure 4:
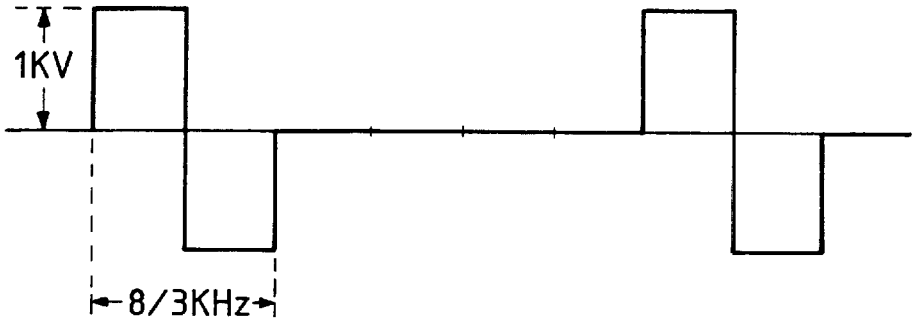
FIG. 4 shows a pattern of an alternating electric field used in Examples 11 and 30.

Using a two component type developer comprised of a combination of the toner 1 and carrier 1 used in Example 1 and using the image forming system as shown in FIG. 1, having a developing sleeve inside provided with a magnet roller constituted of five poles having a main developing pole of 960 gauss, image reproduction was tested while superimposing the alternating electric field shown in FIG. 4 and under development conditions of $V_{cont}$: 250 V; Vback: −130 V; and temperature/humidity: 26° C./60% RH.

As a result, more highly minute images than those in Example 1 were obtained, and also there was no problem on the running performance.

Example 12

Figure 5:
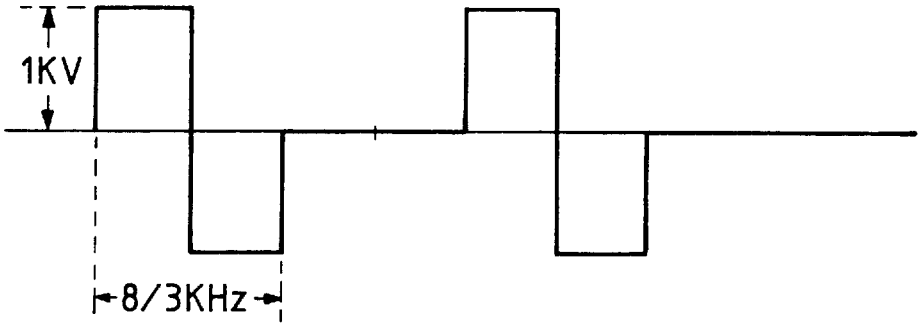
FIG. 5 shows a pattern of an alternating electric field used in Examples 12 and 29.

Image reproduction was tested in the same manner as in Example 11 except that the alternating electric field used therein was replaced with the alternating electric field shown in FIG. 5. As a result, although the photographic reproducibility slightly lowered than that in Example 11, good results were obtained.

Polyester Resin Synthesis Example 1

| | |
|---|---|
| Polyoxypropylene(2,2)-2,2-bis(4-hydroxyphenyl)propane | 45 mol % |
| Polyoxyethylene(2)-2,2-bis(4-hydroxyphenyl)propane | 6 mol % |
| Fumaric acid | 47 mol % |
| Trimellitic anhydride | 2 mol % |

To the above materials, dibutyltin oxide was added as a catalyst, and condensation polymerization reaction was carried out in a stream of nitrogen at 200° C. The reaction was terminated when the softening point according to ASTM E28-51T reached 92° C. to obtain polyester resin (I).

The resin had an acid value of 9.5 KOH mg/g and a glass transition temperature of 57.2° C.

Polyester Resin Synthesis Example 2

| | |
|---|---|
| Polyoxypropylene(2,2)-2,2-bis(4-hydroxyphenyl)propane | 45 mol % |
| Polyoxyethylene(2)-2,2-bis(4-hydroxyphenyl)propane | 4 mol % |
| Fumaric acid | 40 mol % |
| Terephthalic acid | 10 mol % |
| Trimellitic anhydride | 1 mol % |

To the above materials, dibutyltin oxide was added as a catalyst, and condensation polymerization reaction was carried out in a stream of nitrogen at 200° C. The reaction was terminated when the softening point according to ASTM E28-51T reached 91° C. to obtain polyester resin (II).

The resin had an acid value of 22.0 KOH mg/g and a glass transition temperature of 55.3° C.

Polyester Resin Synthesis Example 3

| | |
|---|---|
| Polyoxypropylene(2,2)-2,2-bis(4-hydroxyphenyl)propane | 45 mol % |
| Polyoxyethylene(2)-2,2-bis(4-hydroxyphenyl)propane | 10 mol % |
| Fumaric acid | 43 mol % |
| 1,2,5-Hexanetricarboxylic acid | 2 mol % |

To the above materials, dibutyltin oxide was added as a catalyst, and condensation polymerization reaction was carried out in a stream of nitrogen at 200° C. The reaction was terminated when the softening point according to ASTM E28-51T reached 95° C. to obtain polyester resin (III).

The resin had an acid value of 0.8 KOH mg/g and a glass transition temperature of 58.1° C.

Polyester Resin Synthesis Example 4

| | |
|---|---|
| Polyoxypropylene(2,2)-2,2-bis(4-hydroxyphenyl)propane | 49 mol % |
| Terephthalic acid | 49 mol % |
| 2,5,7-Naphthalenetricarboxylic acid | 2 mol % |

To the above materials, dibutyltin oxide was added as a catalyst, and condensation polymerization reaction was carried out in a stream of nitrogen at 200° C. The reaction was terminated when the softening point according to ASTM E28-51T reached 92° C. to obtain polyester resin (IV).

The resin had an acid value of 17.1 KOH mg/g and a glass transition temperature of 57° C.

Polyester Resin Synthesis Example 5

| | |
|---|---|
| Polyoxypropylene(2,2)-2,2-bis(4-hydroxyphenyl)propane | 53 mol % |
| Fumaric acid | 45 mol % |
| 1,2,7,8-Octanetetracarboxylic acid | 2 mol % |

To the above materials, dibutyltin oxide was added as a catalyst, and condensation polymerization reaction was carried out in a stream of nitrogen at 200° C. The reaction was terminated when the softening point according to ASTM E28-51T reached 95° C. to obtain polyester resin (V).

The resin had an acid value of 2.2 KOH mg/g and a glass transition temperature of 59° C.

Polyester Resin Synthesis Example 6

| | |
|---|---|
| Polyoxypropylene(2,2)-2,2-bis(4-hydroxyphenyl)propane | 50 mol % |
| Terephthalic acid | 49.5 mol % |
| Trimellitic anhydride | 0.5 mol % |

To the above materials, dibutyltin oxide was added as a catalyst, and condensation polymerization reaction was carried out in a stream of nitrogen at 200° C. The reaction was terminated when the softening point according to ASTM E28-51T reached 103° C. to obtain polyester resin (VI).

The resin had an acid value of 8.7 KOH mg/g and a glass transition temperature of 61° C.

Toner Production Example 3

| | |
|---|---|
| Polyester resin (I) obtained by condensation of propoxylated bisphenol and fumaric acid | 100 parts |
| Phthalocyanine pigment | 4 parts |
| Metallic complex of di-tert-butylsalicylic acid | 4 parts |

The above materials were thoroughly premixed by means of a Henschel mixer, and then melt-kneaded using a twin-screw extrusion kneader. After cooled, the kneaded product was crushed using a hammer mill to give coarse particles of about 1 to 2 mm in diameter, which were then finely pulverized using a fine grinding mill of an air-jet system. The resulting finely pulverized product was classified to obtain a blue color powder with a weight average particle diameter of 5.8 $\mu$m.

In 100 parts by weight of the color powder, 1.5 part by weight of fine alumina powder (average particle diameter:

0.02 μm; hydrophobicity: 65%) treated with 20 parts by weight of iso-$C_4H_9$—Si—$(OCH_3)_3$ in a mixed solvent of water and butanol was mixed by means of a Henschel mixer to obtain cyan toner 3.

This toner had an acid value of 9.5 KOH mg/g, Tm of 90° C. and Tg of 55° C.

Toner Production Example 4

Cyan toner 4 was obtained in the same manner as in Toner Production Example 3 except that the treated alumina used therein was replaced with fine titanium oxide powder (average particle diameter: 0.03 μm; hydrophobicity: 60%) treated with 25 parts by weight of n-$C_4H_9$—Si—$(OCH_3)_3$ in an aqueous medium.

This toner had the same acid value, Tm and Tg as those of the toner 3.

Toner Production Examples 5 to 9

Toners 5 to 9 were obtained in the same manner as in Toner Production Example 3 except that the polyester resin (I) used therein was replaced with polyester resins (II) to (VI), respectively.

Make-up and properties of the toners 3 to 9 thus obtained are shown in Table 3.

TABLE 3

| | Polyester resin | External additive | Weight average particle diameter (μm) | Acid value (KOHmg/g) | Tm (° C.) | Tg (° C.) |
|---|---|---|---|---|---|---|
| Toner 3 | (I) | $Al_2O_3$ | 5.8 | 9.5 | 90 | 55 |
| Toner 4 | (I) | $TiO_2$ | 5.8 | 9.5 | 90 | 55 |
| Toner 5 | (II) | $Al_2O_3$ | 6.1 | 22.0 | 88 | 54 |
| Toner 6 | (III) | $Al_2O_3$ | 5.6 | 0.8 | 93 | 56 |
| Toner 7 | (IV) | $Al_2O_3$ | 6.0 | 17.1 | 91 | 56 |
| Toner 8 | (V) | $Al_2O_3$ | 5.8 | 2.2 | 93 | 57 |
| Toner 9 | (VI) | $Al_2O_3$ | 5.9 | 8.7 | 100 | 60 |

Examples 13 and 14

Figure 2:
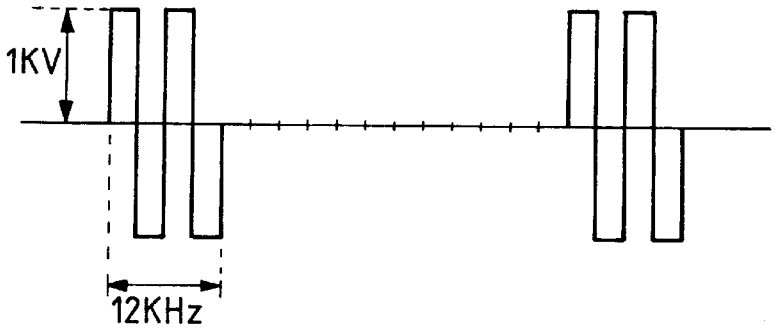
FIG. 2 shows a pattern of an alternating electric field used in Examples 13 to 18.

The cyan toners 3 and 4 described above were each blended with the carrier 1 in a toner concentration of 7% to produce two component type developers. Using the developers thus obtained and using a color copying machine CLC-700 (manufactured by Canon Inc.) whose electrostatic latent image bearing member was replaced with an electrostatic latent image bearing member (I) containing 30% by weight of fluorine-containing resin particles in its protective layer and to which a discontinuous electric field as shown in FIG. 2 was applied as an alternating electric field, an original with an image area percentage of 25% was copied at development contrast of 300 V to reproduce images on 10,000 copy sheets in environments of 30° C./80% RH and 20° C./10% RH. Results obtained are shown in Table 4.

Reference Examples 15 and 16 and Examples 17 and 18

Images were reproduced in the same manner as in Examples 13 and 14 except that the cyan toners 3 and 4 used therein were replaced with the cyan toners 5 to 8 each, to obtain the results as shown in Table 4. Reference Examples 15 and 16, employing the toner 5 with a high acid value and the toner 6 with a low acid value, respectively, caused a little toner scatter compared with Examples 13 and 14, which, however, was at a level not problematic in practical use.

Example 19

Images were reproduced in the same manner as in Examples 13 and 14 except that the toners 3 and 4 used therein were replaced with the toner 9. As a result, although image gloss decreased and image density slightly decreased, good results were obtained as shown in Table 4.

Reference Example 20 and Examples 21–23

Images were reproduced in the same manner as in Examples 13 and 14 except that the carrier 1 used therein was replaced with the carriers 2, 3, 4 and 5 each. As a result, good results were obtained as shown in Table 4.

Reference Example 24

Images were reproduced in the same manner as in Examples 13 and 14 except that the carrier 1 used therein was replaced with the carrier 6. As a result, although running performance slightly lowered because of the coat material which was not the silicone resin, good results were obtained as shown in Table 4.

Example 25

Images were reproduced in the same manner as in Examples 13 and 14 except that the carrier 1 used therein was replaced with the carrier 7. As a result, good results were obtained as shown in Table 4.

Examples 26 to 28

Images were reproduced in the same manner as in Examples 13 and 14 except that the electrostatic latent image bearing member (I) used therein was replaced with electrostatic latent image bearing members (II) to (IV) each, whose content of the fluorine-containing resin particles in the protective layer was changed to 20% by weight, 6% by weight or 0% by weight, respectively. Results obtained are shown in Table 4. Although solid image uniformity slightly decreased with a decrease in the content of fluorine-containing resin particles, there was no problem at all in practical use.

Examples 29 and 30

Images were reproduced in the same manner as in Examples 13 and 14 except that the alternating electric field used therein was replaced with alternating electric fields shown in FIGS. 5 and 4, respectively. As a result, good results were obtained as shown in Table 4.

Example 31

Images were reproduced in the same manner as in Examples 13 and 14 except that the alternating electric field used therein was replaced with a continuous electric field as shown in FIG. 3. As a result, although image density slightly decreased and solid image uniformity also slightly decreased which, however, were at a level not problematic in practical use as shown in Table 4.

TABLE 4

| | | | | | | 30° C./80% RH | | | | | 20° C./10% RH | | | | |
|---|---|---|---|---|---|---|---|---|---|---|---|---|---|---|---|
| | | | | Latent image | | Initial stage | After 10,000 sh. running | | | | Initial stage | After 10,000 sh. running | | | |
| | Carrier No. | Toner No. | Toner concentration (%) | bearing member (wt. %) | Alternating electric field | Charge quantity (mc/kg) | Charge quantity (mc/kg) | (2) | (3) | (4) | Charge quantity (mc/kg) | Charge quantity (mc/kg) | (2) | (3) | (4) |
| Example: | | | | | | | | | | | | | | | |
| 13 | 1 | 3 | 7 | (I) 30 | FIG. 2 | −29 | −28 | AA | 1.1 | AA | −37 | −37 | AA | 1.2 | AA |
| 14 | 1 | 4 | 7 | (I) 30 | FIG. 2 | −28 | −27 | AA | 1.1 | AA | −36 | −36 | AA | 1.2 | AA |
| Reference Example: | | | | | | | | | | | | | | | |
| 15 | 1 | 5 | 7 | (I) 30 | FIG. 2 | −24 | −21 | AB | 1.6 | AB | −30 | −29 | AA | 1.3 | AA |
| 16 | 1 | 6 | 7 | (I) 30 | FIG. 2 | −31 | −31 | AA | 0.9 | AA | −40 | −44 | AB | 1.7 | AB |
| Example: | | | | | | | | | | | | | | | |
| 17 | 1 | 7 | 7 | (I) 30 | FIG. 2 | −25 | −23 | A | 1.4 | A | −32 | −31 | AA | 1.2 | AA |
| 18 | 1 | 8 | 7 | (I) 30 | FIG. 2 | −30 | −29 | AA | 1.0 | AA | −38 | −40 | A | 1.6 | A |
| 19 | 1 | 9 | 7 | (I) 30 | FIG. 2 | −29 | −28 | AA | 1.1 | AA | −37 | −37 | AA | 1.2 | AA |
| Reference Example: | | | | | | | | | | | | | | | |
| 20 | 2 | 3 | 5 | (I) 30 | FIG. 2 | −28 | −25 | AA | 1.5 | AA | −37 | −35 | AA | 1.8 | AB |
| Example: | | | | | | | | | | | | | | | |
| 21 | 3 | 3 | 7 | (I) 30 | FIG. 2 | −28 | −26 | AA | 1.3 | AA | −35 | −36 | AA | 1.2 | AA |
| 22 | 4 | 3 | 7 | (I) 30 | FIG. 2 | −27 | −26 | AA | 1.2 | AA | −36 | −36 | AA | 1.3 | AA |
| 23 | 5 | 3 | 7 | (I) 30 | FIG. 2 | −29 | −28 | AA | 1.2 | AA | −37 | −37 | AA | 1.3 | AA |
| Reference Example: | | | | | | | | | | | | | | | |
| 24 | 6 | 3 | 7 | (I) 30 | FIG. 2 | −29 | −27 | AA | 1.2 | AA | −38 | −37 | AA | 1.4 | AA |
| Example: | | | | | | | | | | | | | | | |
| 25 | 7 | 3 | 7 | (I) 30 | FIG. 2 | −31 | −30 | AA | 1.0 | AA | −40 | −40 | AA | 1.1 | AA |
| 26 | 1 | 3 | 7 | (II) 20 | FIG. 2 | −29 | −28 | AA | 1.1 | AA | −37 | −37 | AA | 1.2 | AA |
| 27 | 1 | 3 | 7 | (III) 6 | FIG. 2 | −29 | −28 | AA | 1.2 | AA | −37 | −37 | A | 1.3 | AA |
| 28 | 1 | 3 | 7 | (IV) 0 | FIG. 2 | −29 | −28 | A | 1.3 | AA | −37 | −37 | AB | 1.4 | AA |
| 29 | 1 | 3 | 7 | (I) 30 | FIG. 5 | −29 | −28 | A | 1.2 | AA | −37 | −37 | A | 1.4 | AA |
| 30 | 1 | 3 | 7 | (I) 30 | FIG. 4 | −29 | −28 | AA | 1.1 | AA | −37 | −37 | AA | 1.2 | AA |
| 31 | 1 | 3 | 7 | (I) 30 | FIG. 3 | −29 | −28 | AB | 1.6 | AA | −37 | −37 | AB | 1.7 | AA |

(1): F-containing resin concentration
(2): Image quality; (3): Fog; (4): In-machine toner scatter In the foregoing Examples, the charge quantity, image quality, fog and in-machine toner scatter were evaluated according to the following evaluation method.

Charge Quantity

A method of measurement will be described in detail with reference to FIG. 9.

Figure 9:
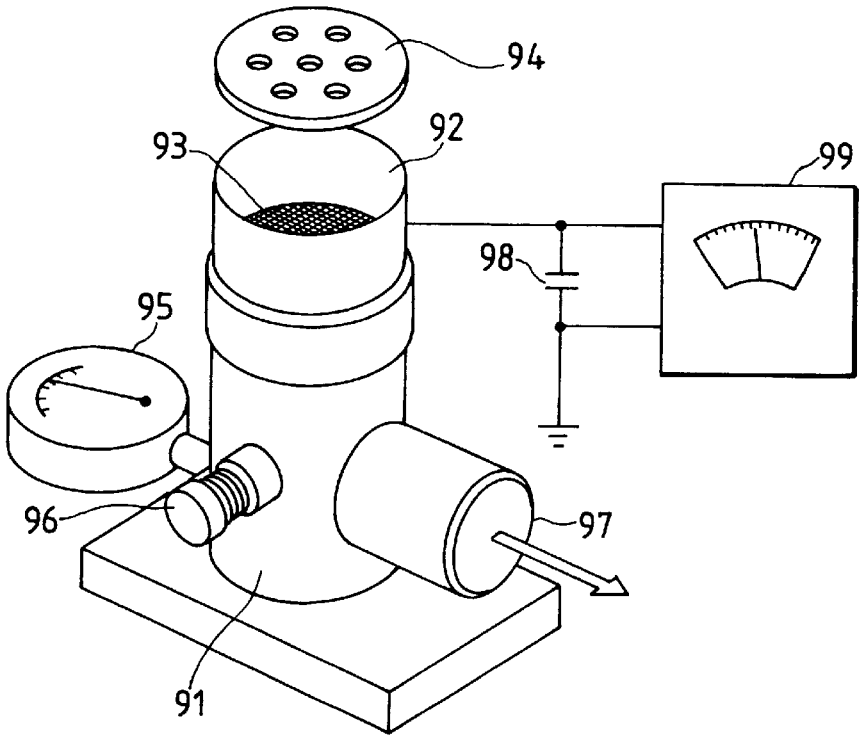
FIG. 9 illustrates a device for measuring quantity of triboelectricity of toner.

FIG. 9 illustrates a unit for measuring the quantity of triboelectricity of toner. In a measuring container 92 made of a metal at the bottom of which is provided a screen 93 of 500 meshes, about 0.5 to 0.9 g of a mixture of toner and carrier (a developer) is put and the container is covered with a plate 94 made of a metal. The total weight of the measuring container 92 in this state is weighed and is expressed by $W_1$ (kg). Next, in a suction device 91 (made of an insulating material at least at the part coming into contact with the measuring container 92), air is sucked from a suction opening 97 and an air-flow control valve 96 is operated to control the pressure indicated by a vacuum indicator 95 so as to be 250 mmAq ($mmH_2O$). In this state, suction is sufficiently carried out preferably for about 2 minutes to remove the toner by suction. The potential indicated by a potentiometer 99 at this time is expressed by V (volt). Reference numeral 98 denotes a capacitor, whose capacitance is expressed by C (mF). The total weight of the measuring container after completion of the suction is also weighed and is expressed by $W_2$ (g). The quantity (mC/kg) of triboelectricity is calculated as shown by the following equation.

Quantity of Triboelectricity of Toner $$(mC/kg)=(C\times V)/(W_1-W_2)$$

Image Quality

CLC SK paper (available from Canon Sales Co., Inc.) is left to stand for 3 days, and thereafter images are reproduced thereon, and uniformity (in particular, transfer uniformity) of halftone images with a Macbeth density of 0.6 was evaluated.

AA: Very good (no problem at all).
A: Good.
AB: At a little low level, but no problem.
B: A little problematic.

Fog

Fog is evaluated by measuring it using REFLECTOMETER MODEL TC-6DS (manufactured by Tokyo Denshoku Co., Ltd.). For its measurement on cyan toner images, amber filter was used. The fog is calculated according to the following expression. The smaller the value is, the less the fog is.

Fog(reflectance)(%)=Reflectance(%)of standard paper−Reflectance(%)of non-image area of sample.

Toner Scatter (in-machine)

In-machine toner scatter was examined by observing contamination caused by toner on the outer surfaces of the upstream side toner scatter preventive member and downstream side toner scatter preventive member of the developing container, and contamination caused by toner on the members other than the developing container. Evaluation was made according to the following criterions.

AA: No contamination is seen at all.

A: Contamination is slightly seen on the outer surface of the upstream side toner scatter preventive member of the developing container, but no contamination on the outer surface of the downstream side toner scatter preventive member.

AB: Contamination is seen on the outer surfaces of the upstream side toner scatter preventive member and downstream side toner scatter preventive member of the developing container, but no contamination on the members other than the developing container.

B: Contamination is seen also on the members other than the developing container.

What is claimed is:

1. An image forming method comprising:

rotationally transporting a two component developer having a toner and a carrier, onto a developer carrying member; and developing in a developing zone an electrostatic latent image held on an electrostatic latent image bearing member with the toner of the two component developer carried on the developer carrying member, wherein said two component developer comprises (i) a negatively chargeable toner having toner particles and external additive and (ii) a carrier comprising magnetic carrier core particles and a resin coat layer comprising a silicone resin coating the magnetic carrier core particles, said carrier having a weight average particle diameter from 10 to 45 $\mu$m and a saturation magnetization from 20 $Am^2/kg$ to 70 $Am^2/kg$, wherein:

said toner particles comprise a colorant and a binder resin having a polyester resin, said polyester resin being prepared by co-condensing an etherified bisphenol with a mixture comprising a dibasic carboxylic acid and a tribasic or higher carboxylic acid, said tribasic or higher carboxylic acid present in amounts from 0.1 to 10 mole % based on the total moles of the components for preparing the polyester resin, said negatively chargeable toner has an acid value from 1 KOH mg/g to 20 KOH mg/g, a glass transition temperature (Tg) from 45° C. to 70° C. and a weight average particle diameter from 1 to 9 $\mu$m, said external additive comprises inorganic fine particles having been subjected to hydrophobic treatment and having a number average particle diameter from 0.005 $\mu$m to 0.2 $\mu$m; and said magnetic carrier core particles are formed of a magnetic ferrite component represented by the following Formula (I):

$$(Fe_2O_3)_x(MnO)_Y(A)_Z \qquad \text{Formula (I)}$$

wherein A represents a member selected from the group consisting of $Na_2O$, $K_2O$, CaO, SrO and mixtures thereof; and x, y and z each represent a molar fraction and satisfy the condition of:

$$0.3<x<0.8,\ 0.01<Y<0.5,\ 0.06\leqq z\leqq 0.16,\ x+y+z\leqq 1.$$

2. The image forming method according to claim 1, wherein said magnetic carrier particles are formed of a magnetic ferrite component represented by Formula (I):

$$(Fe_2O_3)_x(MnO)_y(A)_z$$

wherein A represents a member selected from the group consisting of $Na_2O$, $K_2O$, CaO, SrO and a mixture of any of these: and x, y and z each represent a molar fraction and satisfy the condition of:

$$0.3<x<0.8,\ 0.01<y<0.5,\ 0.06\leqq z\leqq 0.16,\ x+y<1, z=1-x-y.$$

3. The image forming method according to claim 2, wherein said inorganic fine particles having been subjected to hydrophobic treatment comprise a member selected from the group consisting of fine alumina particles, fine titanium oxide particles and fine silica particles.

4. The image forming method according to claim 2, wherein said inorganic fine particles having been subjected to hydrophobic treatment have a hydrophobicity from 20% to 80%.

5. The image forming method according to claim 2, wherein said inorganic fine particles having been subjected to hydrophobic treatment have a hydrophobicity from 40% to 80%.

6. The image forming method according to claim 2, wherein said inorganic fine particles having been subjected to hydrophobic treatment have a light transmittance of 40% or more at a light wavelength of 400 nm.

7. The image forming method according to claim 1, wherein said toner has a weight average particle diameter from 2 to 8 $\mu$m.

8. The image forming method according to claim 1, wherein said etherified bisphenol is a phenol represented by Formula (II):

(II)

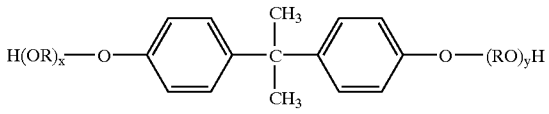

wherein R represents an ethylene group or a propylene group, and x and y each represent an integer of 1 or more, where x+y is 2 to 10 on the average.

9. The image forming method according to claim 1, wherein said inorganic fine particles having been subjected to hydrophobic treatment comprise a member selected from the group consisting of fine alumina particles, fine titanium oxide particles and fine silica particles.

10. The image forming method according to claim 1, wherein said inorganic fine particles having been subjected to hydrophobic treatment have a hydrophobicity from 20% to 80%.

11. The image forming method according to claim 1, wherein said inorganic fine particles having been subjected to hydrophobic treatment have a hydrophobicity from 40% to 80%.

12. The image forming method according to claim 1, wherein said inorganic fine particles having been subjected to hydrophobic treatment have a light transmittance of 40% or more at a light wavelength of 400 nm.

13. The image forming method according to claim 1, wherein said inorganic fine particles comprise a member selected from the group consisting of fine alumina particles and fine titanium oxide particles.

14. The image forming method according to claim 1, wherein x and y in Formula (I) are each, respectively, $0.4<x<0.8$, and $0.02<y<0.3$.

15. The image forming method according to claim 1, wherein said magnetic carrier particles contain $Bi_2O_3$ in an amount of from 0.01 mol % to 3 mol % based on the moles of the magnetic ferrite component.

16. The image forming method according to claim 1, wherein said binder resin is mainly composed of polyester resin.

* * * * *

UNITED STATES PATENT AND TRADEMARK OFFICE

CERTIFICATE OF CORRECTION

PATENT NO. : 6,641,967 B2 
DATED : November 4, 2003
INVENTOR(S) : Tsuyoshi Takiguchi et al.

It is certified that error appears in the above-identified patent and that said Letters Patent is hereby corrected as shown below:

Title page,
Item [56], References Cited, FOREIGN PATENT DOCUMENTS, insert

| | | |
|---|---|---|
| -- JP | 52-56536 | 5/1977 |
| JP | 54-72054 | 6/1979 |
| JP | 58-23032 | 2/1983 |
| JP | 58-123552 | 7/1983 |
| JP | 58-129437 | 8/1983 |
| JP | 58-144839 | 8/1983 |
| JP | 58-202456 | 11/1983 |
| JP | 58-215664 | 12/1983 |
| JP | 59-111159 | 6/1984 |
| JP | 61-204646 | 9/1986 |
| JP | 62-297857 | 12/1987 |
| JP | 2-877 | 1/1990 |
| JP | 2-222966 | 9/1990 |
| JP | 2-281280 | 11/1990 |
| JP | 6-23865 | 3/1994 |
| JP | EP 0086444 | 8/1993 --. |

Column 6,
Line 30, “wherein;” should read -- wherein: --; and
Line 51, “member; wherein;” should read -- member, wherein: --.

Column 9,
Line 16, “X+Y+Z=1.” should read -- $X+Y+Z \leq 1$. --.

Signed and Sealed this

Twenty-second Day of June, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,641,967 B2
DATED : November 4, 2003
INVENTOR(S) : Tsuyoshi Takiguchi et al.

It is certified that error appears in the above-identified patent and that said Letters Patent is hereby corrected as shown below:

Column 8,
Line 6, “Li2O” should read -- $Li_2O$ --.

Column 9,
Line 21, “an” should read -- a --.

Column 11,
Line 64, “obtain” should read -- obtained --.

Column 13,
Line 22, “whatever” should read -- whenever --; and
Line 42, “Hanze Yellow,” should read -- Hansa Yellow, --.

Column 22,
Line 61, “cell;” should read -- cell: --.

Column 25,
Line 8, “wherein;” should read -- wherein: --.

Column 26,
Line 38, “pulverised” should read -- pulverized --; and
Line 40, “drier.” should read -- dryer. --.

Column 37,
Line 40, “comprising” should read -- comprising: --; and
Line 67, “$(Fe_2O_3)_x(MnO)_Y(A)_Z$” should read -- $(Fe_2O_3)_x(MnO)_y(A)_z$ --.

UNITED STATES PATENT AND TRADEMARK OFFICE

CERTIFICATE OF CORRECTION

PATENT NO. : 6,641,967 B2
DATED : November 4, 2003
INVENTOR(S) : Tsuyoshi Takiguchi et al.

It is certified that error appears in the above-identified patent and that said Letters Patent is hereby corrected as shown below:

Column 38,
Line 5, "0.01 < Y < 0.5," should read -- 0.01 < y < 0.5, --; and
Line 14, "these:" should read -- these; --.

Signed and Sealed this

Eleventh Day of April, 2006

JON W. DUDAS
*Director of the United States Patent and Trademark Office*